US005725319A

United States Patent [19]

Saito et al.

[11] Patent Number: 5,725,319

[45] Date of Patent: Mar. 10, 1998

[54] SHEET FEEDING APPARATUS

[75] Inventors: Hiroyuki Saito; Tetsuo Suzuki; Makoto Kashimura, all of Yokohama; Masahiro Taniguro, Ushiku; Koichi Tanno, Kawasaki; Haruyuki Yanagi, Machida; Tetsuhiro Nitta, Yokohama; Makoto Kawarama, Ayase; Hiroyuki Kinoshita, Kawasaki; Masaya Shinmachi, Kawasaki; Tan At Ming, Kawasaki; Kentaro Ohnuma, Kawasaki; Seiji Ogasawara, Yokohama, all of Japan

[73] Assignee: Canon Kabushiki Kaisha, Tokyo, Japan

[21] Appl. No.: 886,890

[22] Filed: Jul. 2, 1997

Related U.S. Application Data

[63] Continuation of Ser. No. 352,225, Dec. 8, 1994, abandoned.

[30] Foreign Application Priority Data

Dec. 15, 1993 [JP] Japan ..... 5-315331

[51] Int. Cl.[6] ..... B41J 13/00

[52] U.S. Cl. ..... 400/629; 400/624; 347/104; 271/17; 271/248

[58] Field of Search ..... 400/624, 625, 400/629, 579, 641; 271/13, 17, 18, 19, 21, 226, 248, 251; 347/101, 104

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,600,929 | 7/1986 | Cardona et al. | 346/134 |
| 4,608,577 | 8/1986 | Hori . | |
| 4,723,129 | 2/1988 | Endo et al. . | |
| 4,740,796 | 4/1988 | Endo et al. . | |
| 5,088,848 | 2/1992 | De Falco et al. | 400/579 |
| 5,238,235 | 8/1993 | Nitta et al. | 400/629 |
| 5,326,184 | 7/1994 | Shibata | 400/624 |
| 5,480,247 | 1/1996 | Saiawa et al. | 400/629 |

FOREIGN PATENT DOCUMENTS

| | | | |
|---|---|---|---|
| 0 487 923 | 6/1992 | European Pat. Off. . | |
| 54-56847 | 5/1979 | Japan . | |
| 57-112258 | 7/1982 | Japan | 271/248 |
| 59-123670 | 7/1984 | Japan . | |
| 59-138461 | 8/1984 | Japan . | |
| 60-71260 | 4/1985 | Japan . | |
| 63-127952 | 5/1988 | Japan | 271/248 |
| 1-317776 | 12/1989 | Japan | 400/629 |
| 2-043136 | 2/1990 | Japan | 271/248 |
| 3-200653 | 9/1991 | Japan | 271/248 |
| 4-039247 | 2/1992 | Japan | 271/248 |
| 4-175179 | 6/1992 | Japan | 400/629 |
| 4-323148 | 11/1992 | Japan | 271/248 |
| 91/07284 | 5/1991 | WIPO | 400/629 |

OTHER PUBLICATIONS

Patent Abstracts of Japan, vol. 011, No. 034 (M-558), 31 Jan. 1987 & JP 61-203036 A (Hitachi Ltd.), 8 Sep. 1986.

Patent Abstracts of Japan, vol. 012, No. 437 (M-765), 17 Nov. 1988 & JP 63-171749 A (Canon Inc.), 15 Jul. 1988.

"Envelope Feeder"; IBMTDB; R.E. Hunt, vol. 25, No. 2, Jul. 1982.

*Primary Examiner*—David A. Wiecking

*Attorney, Agent, or Firm*—Fitzpatrick, Cella, Harper & Scinto

[57] ABSTRACT

The present invention provides a sheet feeding apparatus comprising a sheet supporting means for supporting a sheet, a rotatable sheet supply means for feeding out the sheet supported by the sheet supporting means and a skew-feed correction means for correcting a skew-feed of the sheet by rotating the sheet in a plane including a surface of the sheet while the sheet is being fed by the rotatable sheet supply means.

23 Claims, 32 Drawing Sheets

ROLLER NEAR TO REFERENCE

ROLLER AWAY FROM REFERENCE

ROLLER NEAR TO REFERENCE

ROLLER AWAY FROM REFERENCE

ROLLER NEAR TO REFERENCE

ROLLER AWAY FROM REFERENCE

ROLLER NEAR TO REFERENCE

ROLLER AWAY FROM REFERENCE

ROLLER NEAR TO REFERENCE

ROLLER AWAY FROM REFERENCE

SHEET FEEDING APPARATUS

This application is a continuation of application Ser. No. 08/352,225, filed Dec. 8, 1994, now abandoned.

BACKGROUND OF THE INVENTION

1. Field of the Invention

The present invention relates to a sheet feeding apparatus incorporated into a recording apparatus such as a facsimile machine, a copying machine, a printer and the like, and more particularly, it relates to a sheet feeding apparatus for separating and supplying sheets one by one.

2. Related Background Art

Conventionally, in recording apparatuses such as a printers, copying machines, facsimile machines and the like, a thick sheet such as a post card, an envelope and the like, or a special sheet such as a plastic film has been used as a recording sheet, as well as a normal sheet. The recording sheet is supplied by manually inserting the sheet one by one or by feeding the sheets automatically and continuously one by one by means of an automatic sheet feeding apparatus (ADF).

An example of an automatic sheet feeding apparatus incorporated into a recording apparatus is shown in FIGS. 32A to 32E. The recording apparatus 51 includes an automatic sheet feeding apparatus 52 for separating and supplying sheets P one by one, and a recording portion 53 for recording image information on the supplied sheet.

As shown in FIG. 32A, the recording sheets P rested on a pressure plate 54 are urged against rollers 57 arranged in coaxial with a sheet supply roller 56 by means of compression springs 55, and separation pawls 58 are arranged at front corners of the pressure plate 54. As shown in FIG. 32B, the recording sheets P fed out by rotation of the sheet supply roller 56 are separated one by one by the separation pawls 58, and the separated sheet is guided by a guide portion 59 to be fed between a convey roller 60 and a pinch roller 61 by a predetermined amount, as shown in FIG. 32C. Thereafter, the convey roller 60 is rotated reversely to try to return the recording sheet P. In this case, the sheet supply roller 56 is being stopped while contacting the recording sheet P, so that, due to resiliency of the recording sheet returned by the convey roller 60, the sheet supply roller is subjected to a force for rotating the sheet supply roller in a direction opposite to a sheet feeding direction. However, since the reverse rotation of the sheet supply roller 56 is prevented by means of a reverse rotation preventing mechanism such as a one-way clutch (not shown), the recording sheet P is prevented from returning.

As a result, a tip end of the recording sheet P reaches to a nip between the convey roller 60 and the pinch roller 61, and, as shown in FIG. 32D, a loop is formed in the recording sheet P between the convey roller 60 and the sheet supply roller 56. Due to the formation of the loop, the tip end of the recording sheet P is urged against the nip between the convey roller 60 and the pinch roller 61, so that the tip end of the recording sheet P is corrected to be aligned with a line perpendicular to a sub-scan direction (sheet feeding direction). Then, as shown in FIG. 32E, by driving the convey roller 60, the recording sheet P is sent to a recording position. In this case, the sheet supply roller 56 is also driven by the movement of the recording sheet and is stopped in a waiting condition that a cut-out portion of the sheet supply roller is substantially in parallel with the recording sheet P, and the rollers 57 are rotated by the movement of the recording sheet P.

However, in the above-mentioned conventional automatic sheet feeding apparatus 52, there arose the following problems. That is to say, the construction of the apparatus is complex, and the number of parts is increased. Further, since the control is also complex and the kind of the recording apparatus 51 used with the sheet feeding apparatus is limited, it is difficult to apply one kind of sheet feeding apparatus to various kinds of recording apparatuses. In addition, a time period from after the recording sheet P was supplied from the automatic sheet feeding apparatus 52 to before the image is recorded on the recording sheet at the recording portion 53 is increased.

SUMMARY OF THE INVENTION

An object of the present invention is to provide a sheet feeding apparatus which is simple in construction and can be applied to various recording apparatuses by simplifying the control therefor and in which the number of parts is reduced, and a recording apparatus into which the sheet feeding apparatus can be incorporated and which can reduce a time period from after a recording sheet was supplied to before an image is recorded on the recording sheet.

To achieve the above object, a sheet feeding apparatus according to the present invention comprises a sheet supporting means for supporting a sheet, a rotatable sheet supply means for feeding out the sheet supported by the sheet supporting means, and a skew-feed correction means for correcting a skew-feed of the sheet by rotating the sheet in a plane including a surface of the sheet while the sheet is being fed.

The skew-feed correction means comprises a separating means for separating the rotatable sheet supply means from the sheet which is being fed, and the sheet is rotated by acting the separating means on the sheet at different timings. Alternatively, the skew-feed correction means may be designed so that fed amounts of the sheet fed by the rotatable sheet supply means are differentiated at left and right sides of the sheet, thereby rotating the sheet.

DETAILED DESCRIPTION OF THE PREFERRED EMBODIMENTS (First Embodiment)

Figure 1:
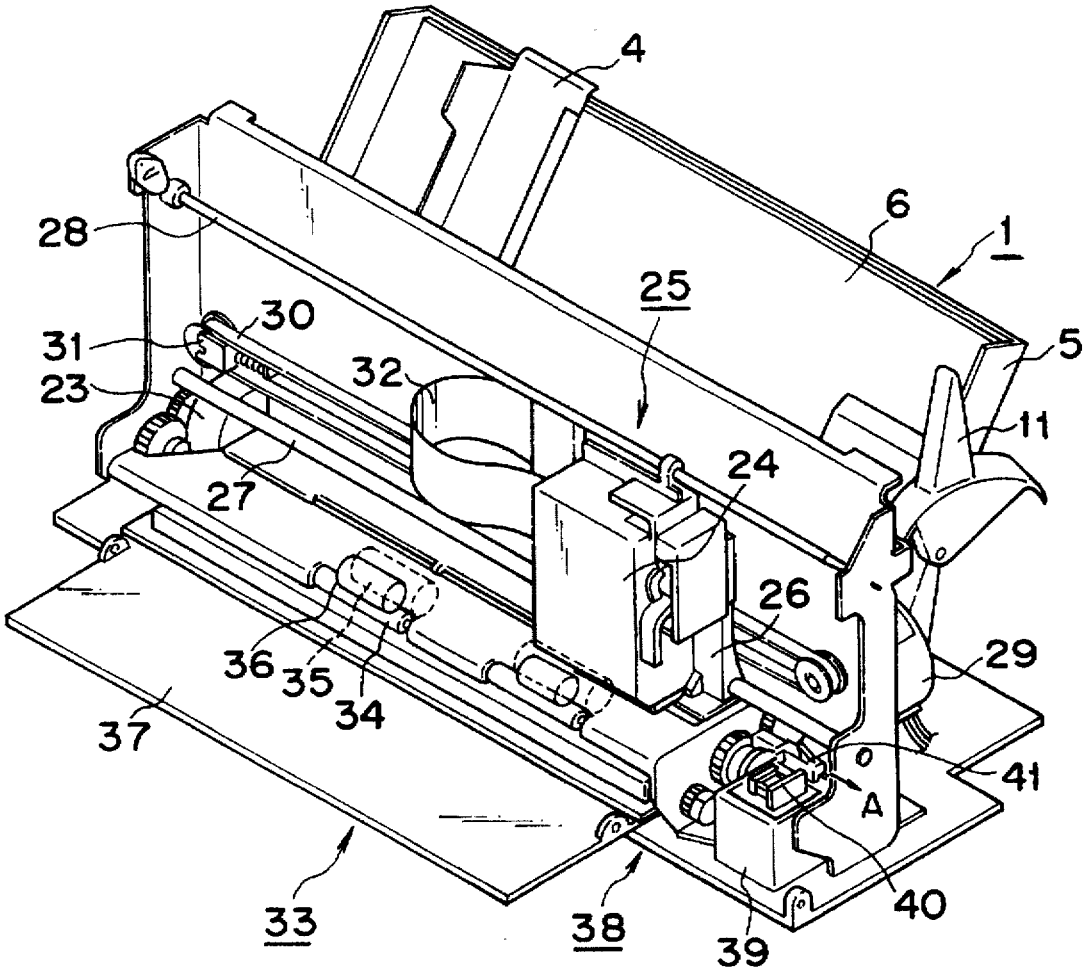
FIG. 1 is a perspective view of an ink jet recording apparatus according to a first embodiment of the present invention.
Figure 2:
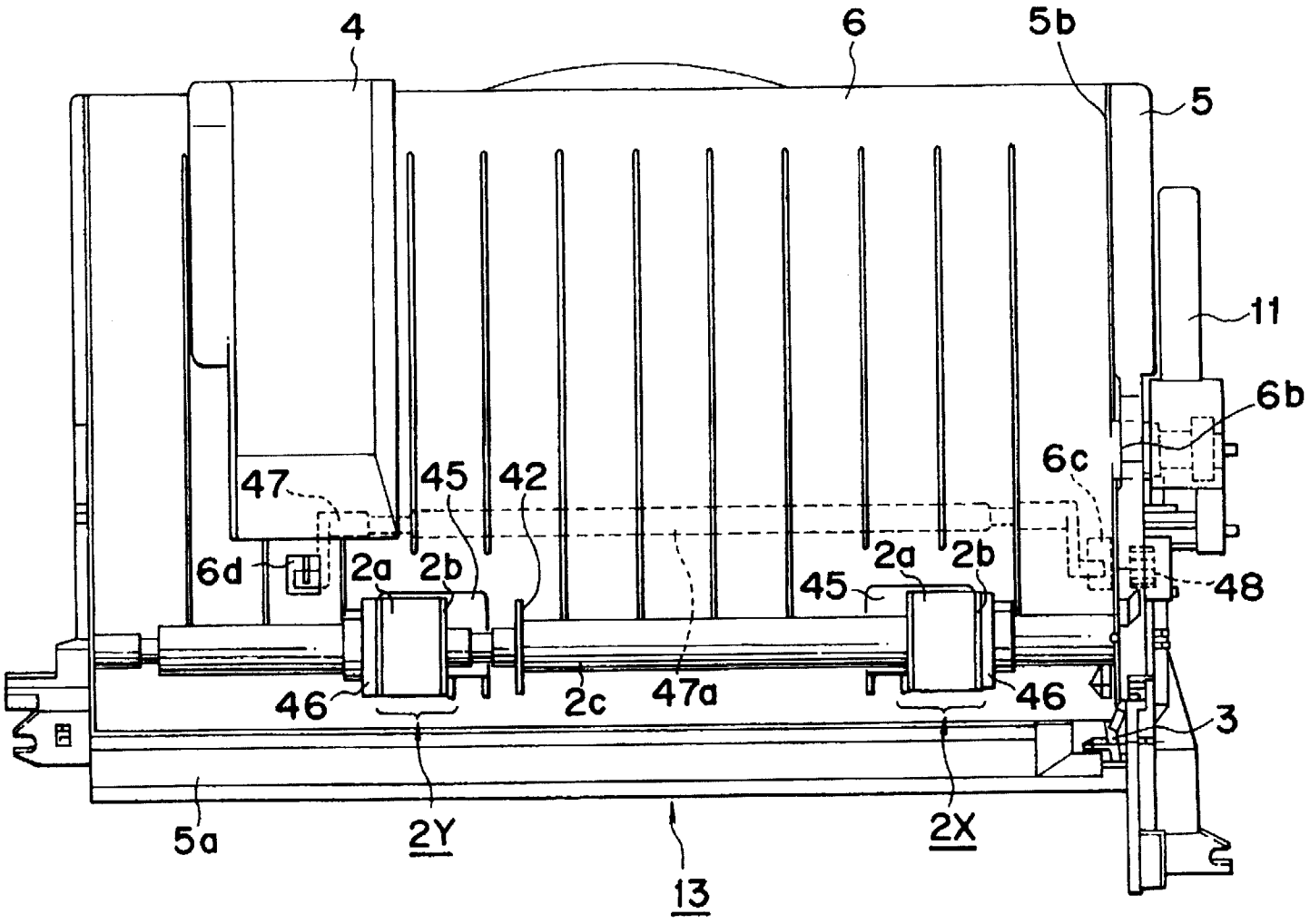
FIG. 2 is plan view of a sheet feeding apparatus.
Figure 3:
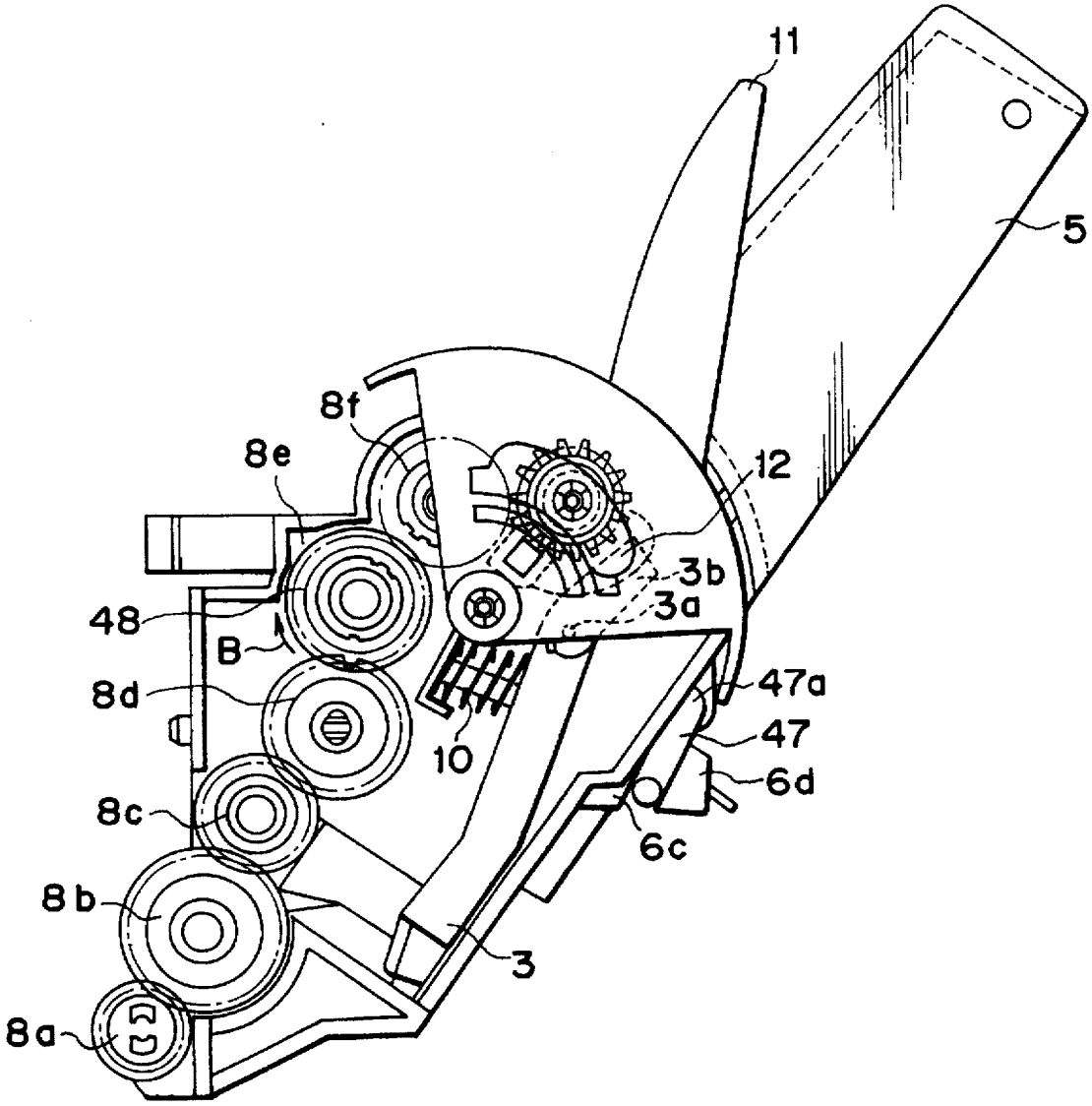
FIGS. 3 and 4 are side views of a drive transmitting mechanism of the sheet feeding apparatus.
Figure 4:
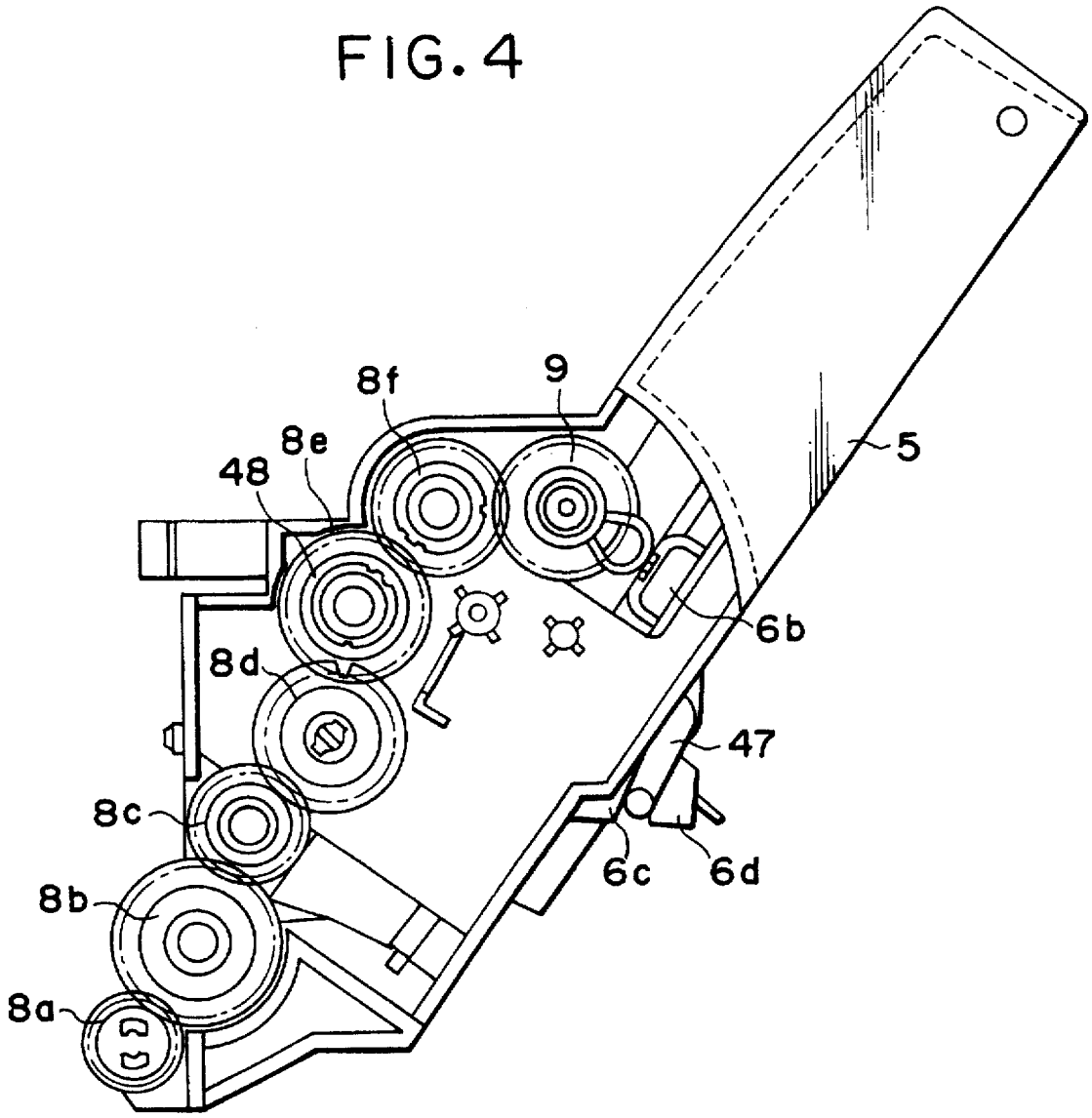
Figure 5:
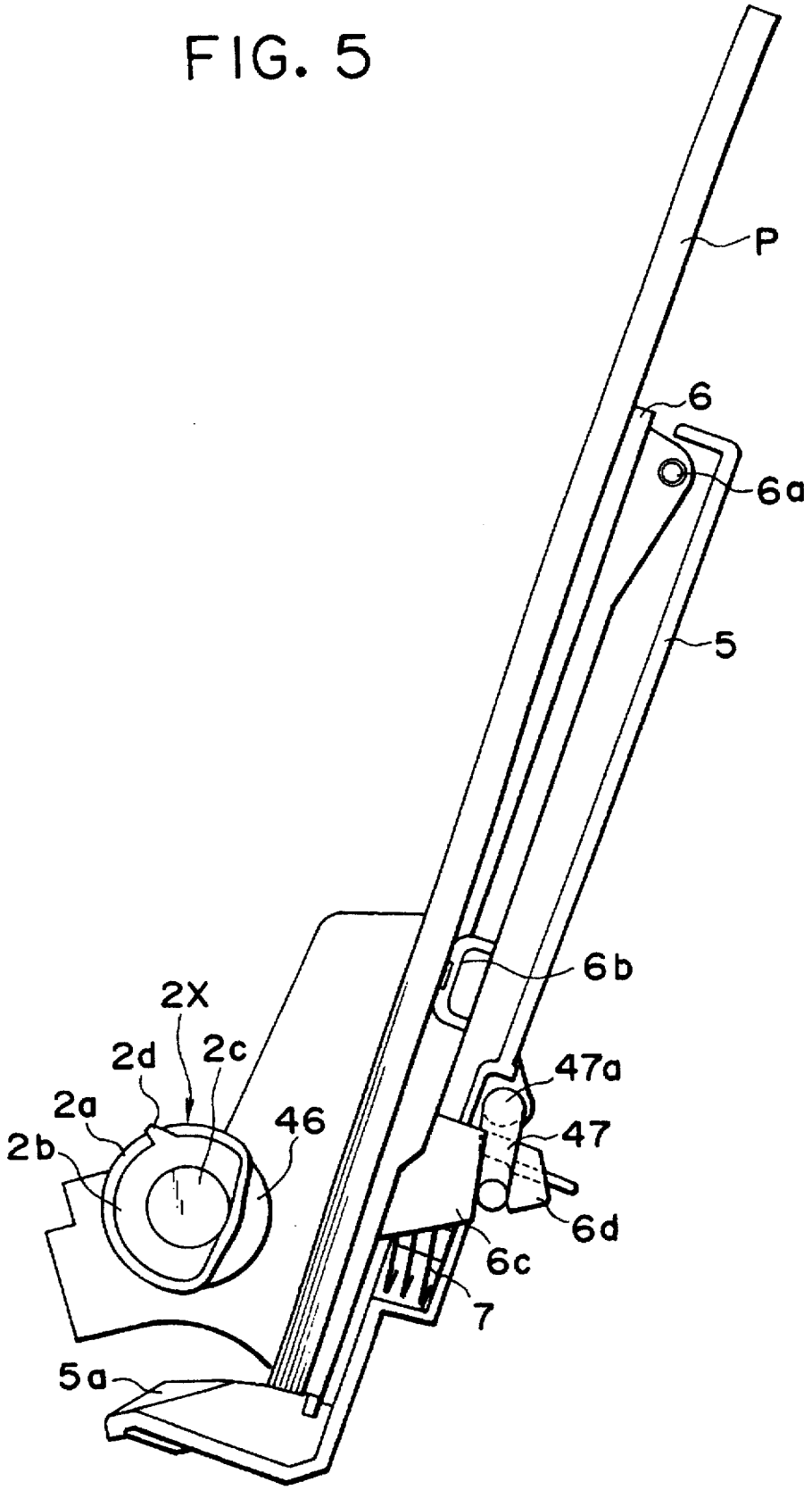
FIGS. 5 and 6 are side views of the sheet feeding apparatus.
Figure 6:
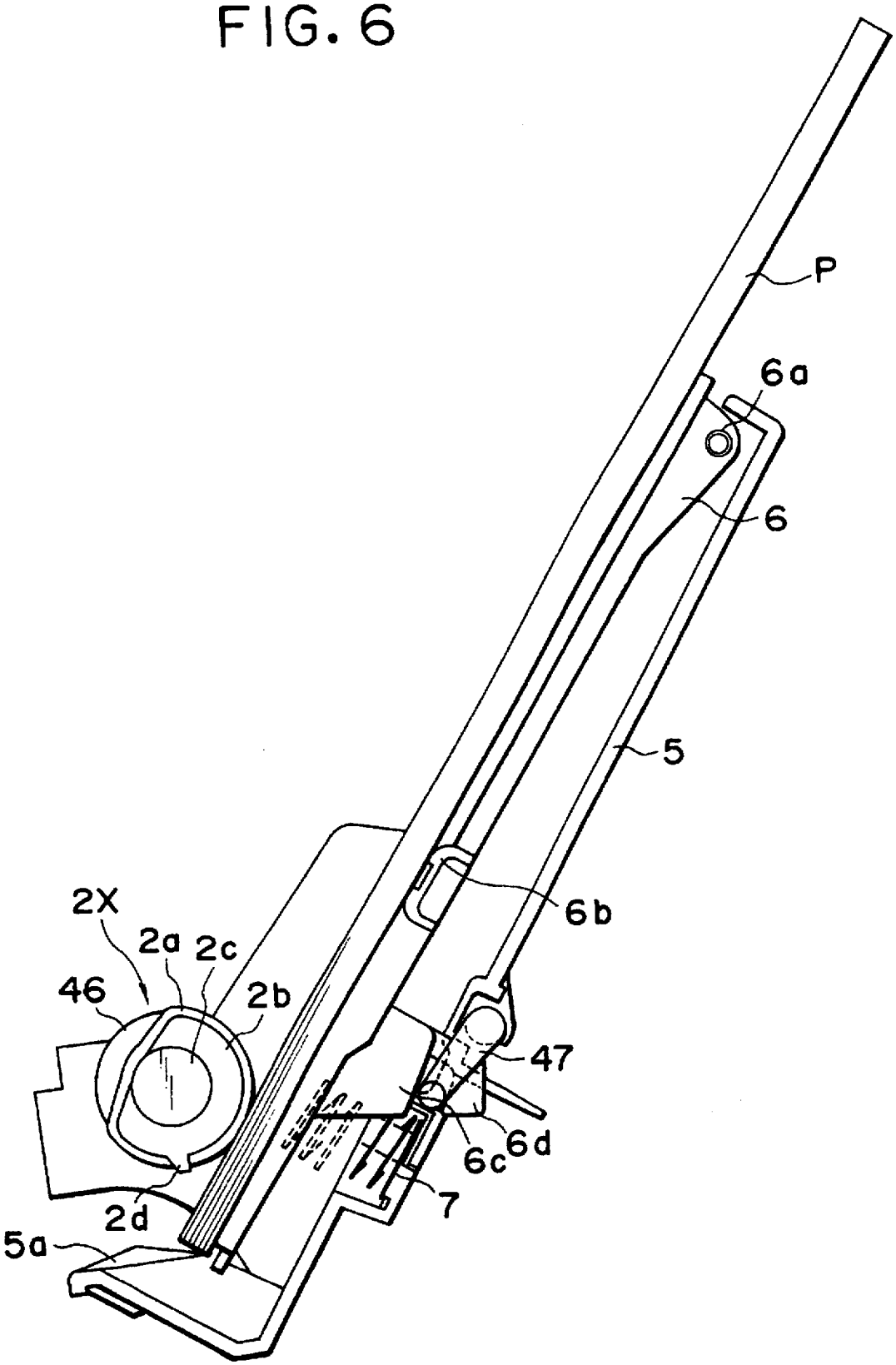
Figure 7:
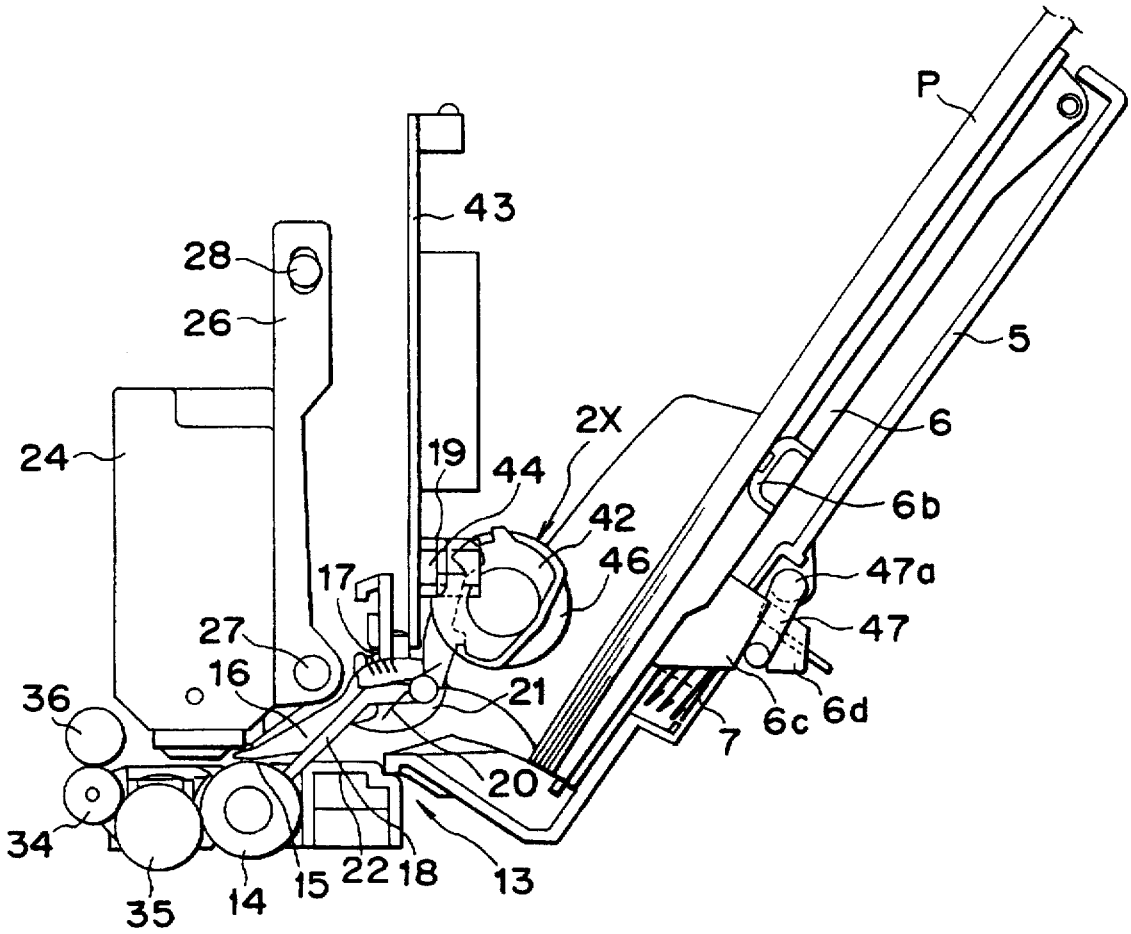
FIG. 7 is a sectional view of the ink jet recording apparatus.
Figure 8:
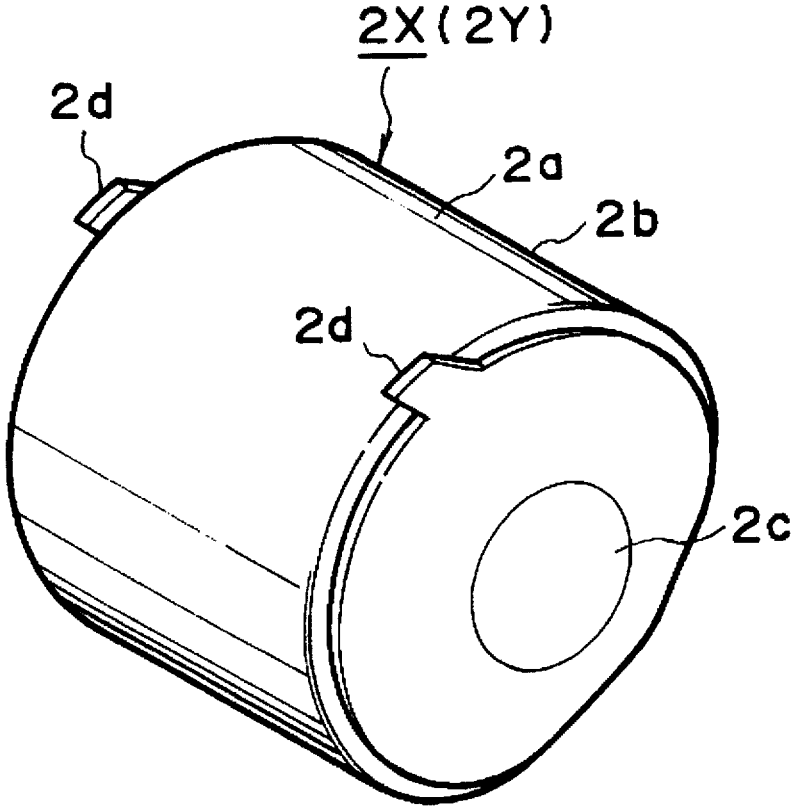
FIG. 8 is a perspective view of a sheet supply roller.
Figure 9A:
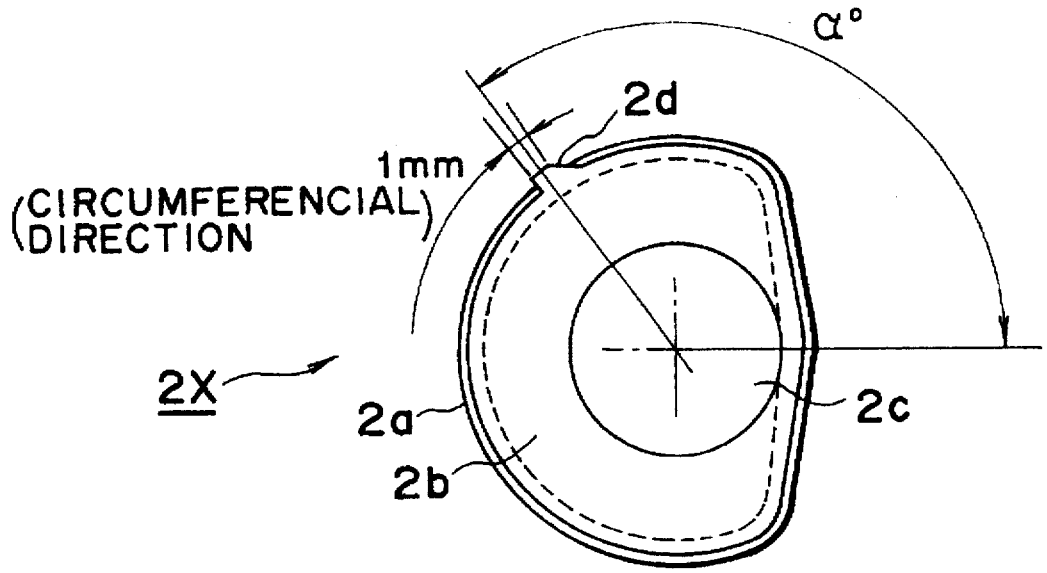
FIGS. 9A and 9B are side views of the sheet supply roller.
Figure 9B:
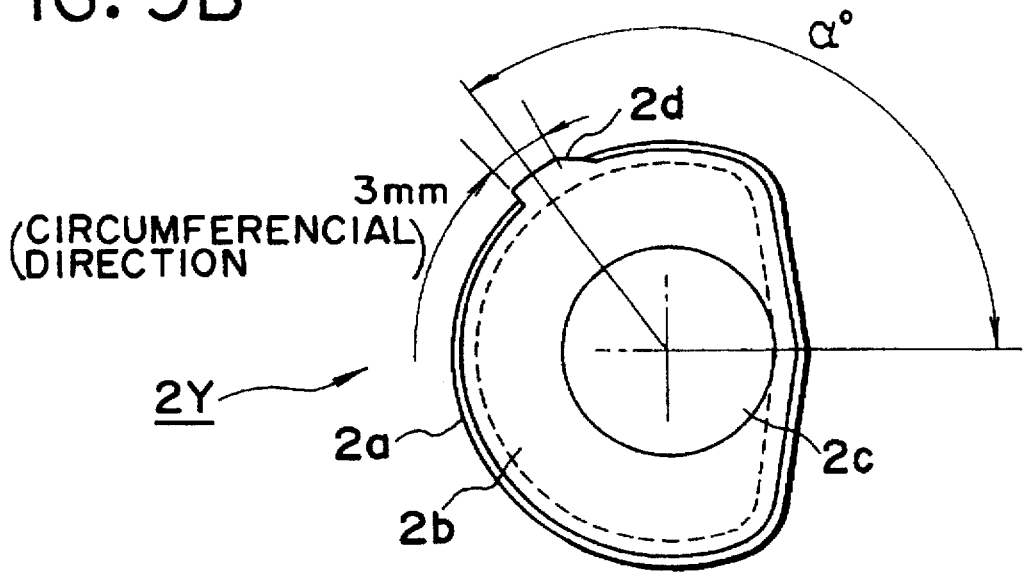

First of all, a sheet feeding apparatus (incorporated into an ink jet recording apparatus) according to a first embodiment of the present invention will be explained with reference to the accompanying drawings. FIG. 1 is a schematic perspective view of the ink jet recording apparatus, FIG. 2 is a plan view of the sheet feeding apparatus, FIGS. 3 and 4 are side views of a drive transmitting mechanism of the sheet feeding apparatus, FIGS. 5 and 6 are side views of the sheet feeding apparatus, FIG. 7 is a sectional view of the ink jet recording apparatus, FIGS. 8, 9A and 9B are views showing a sheet supply roller, FIGS. 10A to 14B are views for explaining a sheet supplying operation, and FIGS. 15A and 15B are flow charts for explaining a control operation for the ink jet recording apparatus.

Now, a schematic construction of the ink jet recording apparatus will be explained with reference to FIGS. 1 to 9B. This embodiment discloses a recording apparatus incorporating an automatic sheet feeding apparatus (ADF), which recording apparatus comprises a sheet supply portion, a sheet feeding portion, a sheet discharge portion, a carriage portion, a cleaning portion and the like.

First of all, explaining the sheet supply portion, as shown in FIG. 1, the sheet supply portion 1 is attached to a body of the recording apparatus in an inclined condition (inclination angle of about 30° to 60°). Incidentally, a recording sheet P on which an image was recorded is discharged horizontally. As shown in FIGS. 2 to 4, the sheet supply portion 1 includes a sheet supply roller (comprising sheet supply roller portions 2X, 2Y), a separation pawl 3, a movable side guide 4, a base 5, a pressure plate 6, pressure plate springs 7 (refer to FIG. 5), drive gears (input gear 8*a*, idle gears 8*b*, 8*c*, 8*e*, sheet supply roller gear 8*d*), a release cam 9, a pawl spring 10, a releasing lever 11 and a releasing cam 12. Since the pressure plate 5 is urged downwardly to a position shown in FIG. 5 by the release cam 9, the recording sheet P is spaced apart from the sheet supply roller portions 2X, 2Y.

After the recording sheets P are set, a driving force of a convey roller 14 (described later) is transmitted to the sheet supply roller portions 2X, 2Y and the release cam 9 through the drive gears 8*a* to 8*e*. When the release cam 9 is separated from the pressure plate 9, the pressure plate 9 is lifted to a position shown in FIG. 6 to contact the sheet supply roller portions 2X, 2Y with the recording sheet P. Then, when the sheet supply roller is rotated, the recording sheets are picked up and are separated one by one by means of the separation pawl 3. The separated recording sheet P is sent to the sheet feeding portion 13 which will be described later. The sheet supply roller portions 2X, 2Y and the release cam 9 are rotated by one revolution until the recording sheet P is sent to the sheet feeding portion 13. Then, the pressure plate 6 is released from the sheet supply roller portions 2X, 2Y so that the driving force from the sheet supply roller portions 2X, 2Y is not transmitted to the recording sheet (initial condition). This initial condition is maintained until a next recording sheet is supplied.

As shown in FIG. 7, the sheet feeding portion 13 includes the above-mentioned convey roller 14, a pinch roller 15, a pinch roller guide 16, a pinch roller spring 17, a PE sensor lever 18, a PE sensor 19, a PE sensor spring 20, an upper guide 21, a platen 22 and the like. The recording sheet P sent to the sheet feeding portion 13 is guided by the platen 22, upper guide 21 and pinch roller guide 16 to be sent to a nip between the convey roller 14 and the pinch roller 15. The PE sensor lever 18 is disposed at an upstream side of the pair of rollers 14, 15 in a sheet feeding direction and serves to detect a tip end of the recording sheet P to provide a reference for determining a record start position. The pinch roller 15 is urged against the convey roller 14 by biasing the pinch roller guide 16 by means of the pinch roller spring 17, so that the pinch roller 15 is driven by rotation of the convey roller 14 to generate a conveying force for the recording sheet P. The recording sheet P sent to the nip between the convey roller 14 and the pinch roller 15 is sent to the record start position by a predetermined amount by rotating the convey roller 14 and the pinch roller 15 by means of an LF motor 23. Then, an image corresponding to predetermined image information is recorded on the recording sheet by a recording head 24.

The recording head 24 serves to record an ink image on the recording sheet P fed by the convey roller 14 and the pinch roller 15. As a recording method, an ink jet recording method for recording an image by discharging ink from a recording head is used. That is to say, the recording head includes fine liquid discharge openings (orifices), liquid passages, energy acting portions arranged in the liquid passages, and an energy generating means for generating liquid droplet generating energy acting on the liquid positioned on the energy acting portion. Such an energy generating means may be used in a recording method wherein electro-mechanical conversion elements such as piezoelectric elements are used, a recording method wherein the liquid droplet is discharged by heating the liquid by illuminating an electromagnetic wave such as laser on the liquid, or a recording method wherein liquid is discharged by heating the liquid by heating the liquid by means of an electrothermal conversion element such as a heating element having a heating resistor.

Among these recording methods, in the ink jet recording method for discharging the liquid by utilizing the thermal energy, since the liquid discharge openings (orifices) for discharging the recording liquid droplets can be arranged with high density in the recording head, the recording with high resolving power can be effected. Among these recording heads, a recording head utilizing the electrothermal conversion elements as the energy generating means is useful, since it can easily be made compact, can fully adopt advantages of IC techniques and/or micro-working techniques (progress of technique and reliability have been remarkably improved in the recent semi-conductor field), can be mounted with high density, and can be made inexpensive.

As shown in FIG. 1, the carriage portion 25 includes a carriage 26 on which the recording head 24 is mounted, a guide shaft 27 along which the carriage 26 is reciprocally shifted (scanned) in a direction perpendicular to the sheet feeding direction, a guide 28 for holding a rear end of the carriage 26 and for maintaining a predetermined distance between the recording head 24 and the recording sheet P, a timing belt 30 for transmitting a driving force of a carriage motor 29 to the carriage 26, an idle pulley 31 for tensioning the timing belt 30, and a flexible cable 32 for transmitting a drive signal from an electric substrate to the recording head 24. The recording head 24 is integrally formed with an ink tank to constitute an exchangeable recording head unit. By shifting the recording head together with the carriage 26, the ink image is recorded on the recording sheet P conveyed on the platen 22.

As shown in FIG. 1, the sheet discharge portion 33 comprises discharge rollers 34, transmission rollers 35 for transmitting the driving force of the convey roller 14 to the discharge rollers 34, spurs 36 for aiding the discharge of the recording sheet P, and a discharge tray 37. The discharge rollers 34 and the spurs 36 serve to discharge the recording sheet P on which the image was recorded, without smudging the recorded surface of the recording sheet.

As shown in FIG. 1, the cleaning portion 38 comprises a pump 39 for cleaning the recording head 24, a cap 40 for suppressing the drying of the recording head 24, and a drive switching arm 41 for switching the transmission of the driving force from the convey roller 14 between the sheet supply portion 1 and the pump 39. The drive switching arm 41 is positioned at a position shown in FIG. 1, except for a sheet supplying operation and a cleaning operation. In this position, since a planetary gear (not shown) capable of rotating an axis of the convey roller 14 is fixed at a predetermined position, the driving force of the convey roller 14 is not transmitted to the sheet supply portion a and the pump 39. When the drive switching arm 41 is shifted to a direction shown by the arrow A in FIG. 1 by shifting the carriage 26, the planetary gear is rotated in response to normal or reverse rotation of the convey roller 14, so that, when the convey roller 14 is rotated in a normal direction, the driving force of the convey roller is transmitted to the sheet supply portion, and, when the convey roller is rotated in a reverse direction, the driving force of the convey roller is transmitted to the pump 39.

Further, the LF motor 23 for driving the convey roller 14 and the carriage motor 29 for driving the carriage 26 comprise stepping motors which are rotated by predetermined angles in response to signals sent from corresponding drivers (not shown). In addition, a sensor plate 42 having a radius smaller than those of roller rubber portions 2a coated around the sheet supply roller portions 2X, 2Y is attached to the sheet supply roller comprising the sheet supply roller portions 2X, 2Y. The sensor plate 42 has a notch so that, only when the release cam 9 is positioned at the position shown in FIG. 5 where the pressure plate 6 is released by the release cam, the notch is aligned with a roller sensor (photo-interrupter) 44 provided on an electric substrate 43 shown in FIG. 7, thereby permitting that light from a light emitting portion of the sensor is received by a light receiving portion of the sensor. By detecting a condition of the sensor plate 42, angular positions of the sheet supply roller portions 2X, 2Y and an angular position of the release cam 9 driven in phase with the sheet supply roller portions 2X, 2Y can be detected, thereby providing control timing in a sheet supply sequence for the recording sheet P.

Next, the sheet supply portion 1 will be fully described. As shown in FIG. 2, in the sheet supply portion 1, various parts or elements are attached to the base 5, thereby providing a unit. According to the illustrated embodiment, the sheet supply portion 1 has a one-side reference for aligning the recording sheets with each other on the basis of one sides of the sheets, and the one-side reference is defined by a right side plate 5b of the base 5. The base 5 also has a recess through which the pressure plate 6 can be retarded as shown in FIG. 6 and within the pressure plate springs 7 are disposed in an opposed relation to the sheet supply roller portions 2X, 2Y (2b). Further, as shown in FIG. 5, the pressure plate 6 is connected to the base via pins 6a provided on both sides of the pressure plate at its upper end, so that the pressure plate can be rotated around the pins 6a. Further, as shown in FIG. 2, separation pads 45 made of material having relatively high coefficient of friction (such as synthetic leather) are adhered to the pressure plate 6 in an opposed relation to the sheet supply roller portions 2X, 2Y, thereby preventing the double-feed of the recording sheets when the number of the recording sheets rested on the pressure plate is greatly decreased. Further, the movable side guide 4 movable to the left and right is mounted on the pressure plate 6 so that the recording sheets P having various sizes can be set by abutting the sheet against the sheet reference by means of the movable guide.

The sheet supply roller comprising the sheet supply roller portions 2X, 2Y is rotatably held, at its both ends, by the base 5. As shown in FIG. 8, each of the sheet supply roller portions 2X, 2Y comprises a roller portion 2b and a shaft portions 2c which are integrally formed from plastic material, thereby providing a one-piece sheet supply roller. The roller rubber 2a is coated on the corresponding roller portion 2b to aid the conveyance of the recording sheet P. The roller portion 2b has a D-shaped (semi-circular) cross-section having a cut-out. Additional rollers 46 each having a radius smaller than that of the roller rubber 2a (attached to the sheet supply roller portion 2X, 2Y) by 0.5 to 3 mm are provided on outer ends of the roller portions 2b to prevent the recording sheet P from contacting with the roller portions 2a except for the sheet supplying operation, thereby preventing the smudge of the recording sheet and the out-of-position of the sheet supply roller portions 2X, 2Y.

Further, as shown in FIG. 2, there are two roller portions 2b attached to the shaft portion 2c, and these roller portions 2b are positioned at positions spaced apart from the sheet reference (right side plate 5b) by about 40 mm and 170 mm, respectively. Accordingly, the recording sheet such as A4 size sheet is conveyed by the two roller portions 2X, 2Y, and the recording sheet such as a post card is conveyed by the single roller portion 2X near the sheet reference. Further, as shown in FIG. 8, ribs 2d each having a radius greater than that of the roller rubber 2a are arranged both sides of the roller portion 2b of each sheet supply roller portion 2X, 2Y. A circumferential length of each rib 2d (referred to as "separation area" hereinafter) is 1 mm regarding the roller portion 2b of the sheet supply roller portion 2X near the sheet reference as shown in FIG. 9A and 3 mm regarding the roller portion 2b of the sheet supply roller portion 2Y remote from the sheet reference as shown in FIG. 9B. And, the separation areas of the roller portions 2X, 2Y have same radius as each other and the same angular position as each other ($\alpha°$ from the center of the cutout).

When the drive switching arm 41 of the cleaning portion 38 is shifted in the direction A by means of the carriage 26 to rotate the convey roller 14 in the normal direction, the planetary gear (not shown) is shifted to be meshed with the input gear 8a shown in FIG. 4, thereby transmitting the driving force to the sheet supply portion 1. The input gear 8a transmits the driving force to the sheet supply roller gear 8d through the idle gears 8b, 8c to rotate the sheet supply roller portions 2X, 2Y, thereby supplying the recording sheet P. Further, the sheet supply roller gear 8d transmits the driving force to the release cam 9 through the clutch gear 8e and the idle gear 8f. In this case, since the sheet supply roller portions 2X, 2Y and the release cam 9 have the same angular phase as each other, in the condition that the pressure plate 6 is released (FIGS. 4 and 5), as shown in FIG. 5, the cut-outs of the sheet supply roller portions 2X, 2Y face to the pressure plate 6.

The release cam 9 is designed so that it releases the pressure plate 6 only while the cut-outs of the sheet supply roller portions 2X, 2Y are opposed to the pressure plate (center angle of about 120 degrees) and it is abutted against the recording sheet P or the pressure plate 6 with pressure of 200 to 500 grams when portions (other than the cut-outs) of the sheet supply roller portions 2X, 2Y are opposed to the pressure plate 6. Further, as shown in FIG. 2, when a push-down portion 6b of the pressure plate 6 protruded from an opening formed in the right side plate 5b of the base 5 is urged downwardly by the release cam 9, the pressure plate 6 is released. As shown in FIG. 7, a pressure plate cam 47 is attached to the base 5, and, when a cam 6c disposed near the push-down portion 6b of the pressure plate 6 is urged downwardly, the pressure plate cam 47 is rotated around a fulcrum 47a, thereby depressing a cam 6d disposed remote from the push-down portion 6b.

With this arrangement, even when the push-down portion 6b disposed near the end of the pressure plate 6 is depressed, the pressure plate is not inclined with respect to the base 5, and, thus, the pressure plate is released substantially in parallel with the base. A clutch spring 48 is arranged within the clutch gear 8e in such a manner that the clutch spring is tightened when the clutch gear is rotated in a direction shown by the arrow B in FIG. 3, thereby preventing the reverse rotation of the clutch gear.

As shown in FIG. 3, the separation pawl 3 can be rotated around a fulcrum 3a and is urged against the recording sheet P or the pressure plate 6 with pressure of 20 to 100 grams. The separation pawl 3 serves to separate the recording sheets P comprising so-called normal sheets during the sheet supplying operation. The separation pawl 3 is positioned near the sheet reference and has a triangular top surface covering one front corner of the recording sheet as shown in FIG. 2. The recording sheets P can be separated one by one when they are subjected to resistance from the triangular pawl. Further, the recording sheets other than normal sheets (such as thick sheets) are separated one by one by abutting the sheets against a lower guide 5a (FIG. 5) of the base 5 (without being caught by the separation pawl 3) to utilize resistance of the lower guide 5a.

As shown in FIG. 3, the releasing lever 11 and the releasing cam 12 arranged on a shaft coaxial with the release cam 9. The releasing lever 11 and the releasing cam 12 are not synchronous with the release cam 9, but are driven independently by the operator to set the recording sheets P. The releasing lever 11 and the releasing cam 12 are connected to each other via gears. The releasing lever 11 can assume one of three positions, i.e., (i) feed position, (ii) thick sheet set position, and (iii) normal sheet set position, which three positions are angularly spaced apart from each other by about 20–50 degrees. The gear ratio is selected so that the releasing cam 12 is rotated by about 90 degrees in correspondence to the three positions of the releasing lever 11.

In the feed position, since the releasing cam 12 urges the push-down portion 6b of the pressure plate 6 alone downwardly, the force of the releasing cam does not act on the push-down portion 3b of the separation pawl 3.

In the thick sheet set position, since the releasing cam 12 urges the push-down portion 6b of the pressure plate 6 alone downwardly, the separation pawl 3 is lowered along the pressure plate 6, with the result that the thick sheets P can be set without being caught by the separation pawl 3.

In the normal sheet set position, since the releasing cam 12 urges the push-down portion 6b of the pressure plate 6 and the push-down portion 3b of the separation pawl 3 downwardly, the separation pawl 3 is lifted with respect to the pressure plate 6, with the result that the normal sheets P can be set with being caught by the separation pawl 3.

Incidentally, the above-mentioned gears (excluding the sheet supply roller gear), separation pawl 3, releasing lever 11 and releasing cam 12 are rotatably mounted on shafts secured to the right side plate 5b of the base 5.

Figure 10A:
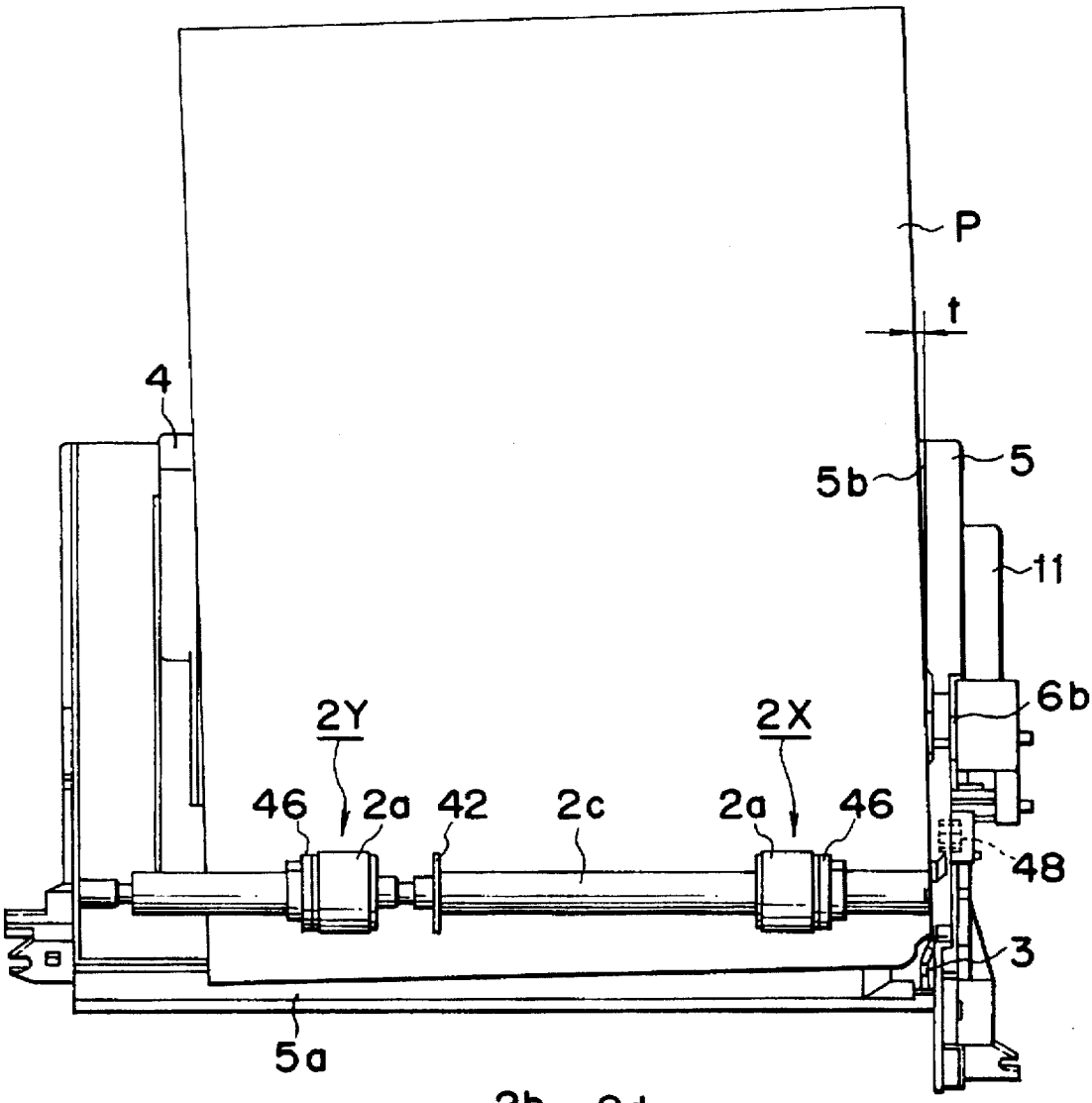
FIGS. 10A, 10B, 11A, 11B, 12A, 12B, 13A, 13B and 14A to 14E are views for explaining a sheet supplying operation.
Figure 10B:
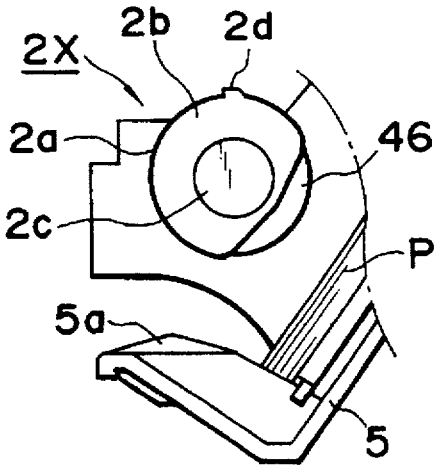

Next, a process for stabilizing the sheet supplying condition by using the separation areas of the sheet supply portion 1 will be explained. First of all, if the separation pawl 3 for regulating the front corner of the recording sheet P is arranged only at one side of the pressure plate, as shown in FIGS. 10A and 10B, the stacked recording sheets P are apt to be lowered around the separation pawl 3 toward a side where the separation pawl does not exist. From this condition, the sheet supplying operation of the recording sheet P contacted with the sheet supply roller portions 2X, 2Y is started by rotating the sheet supply roller portions 2X, 2Y.

Figure 11A:
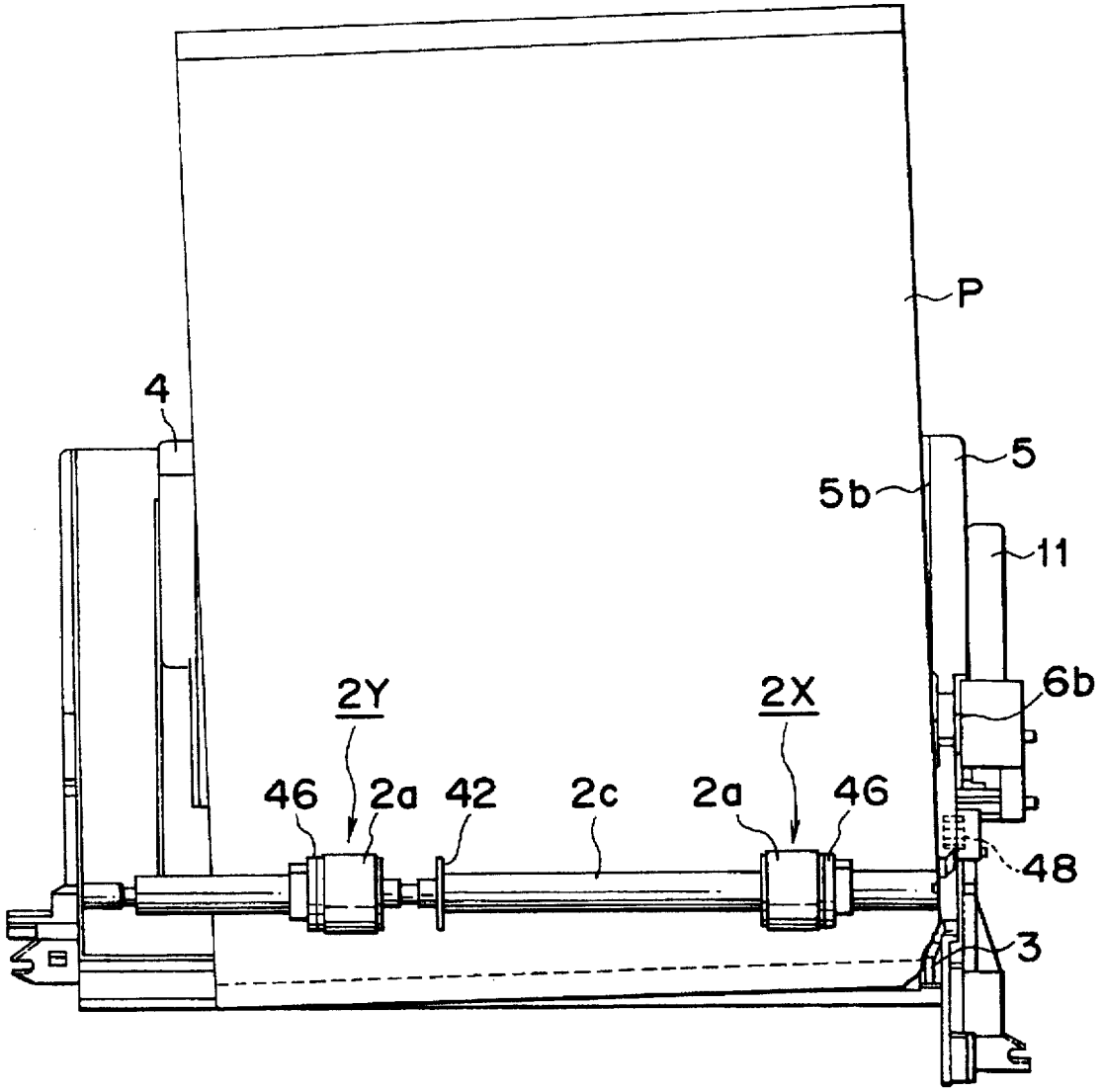
Figure 11B:
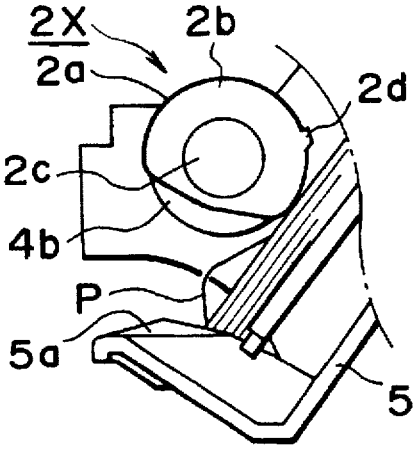
Figure 12A:
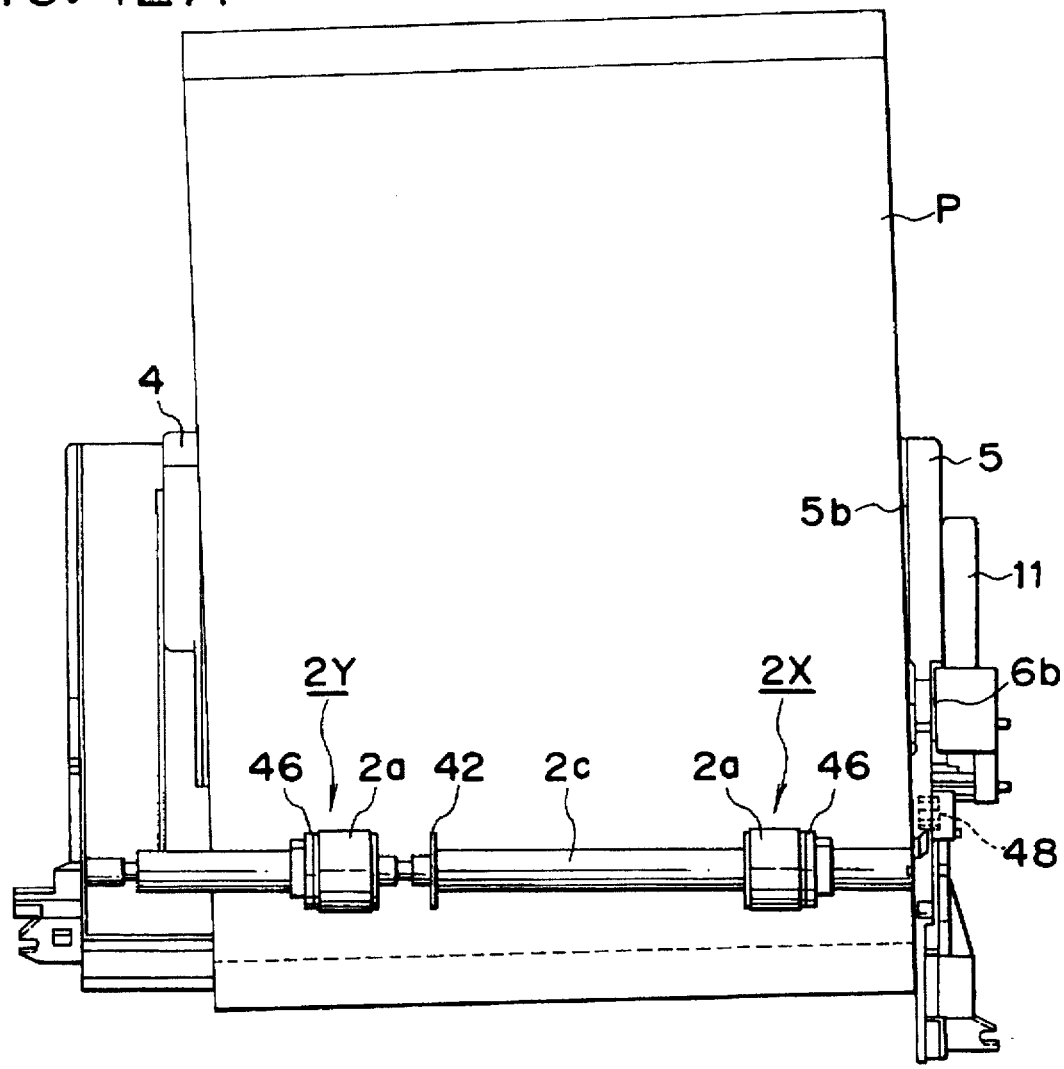
Figure 12B:
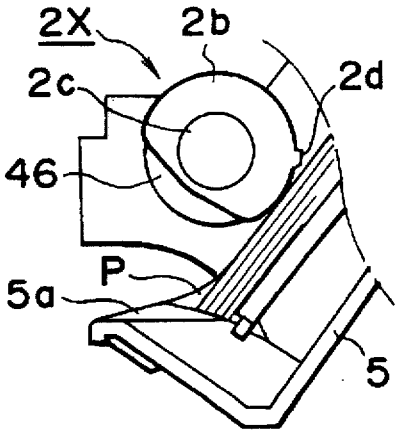

Then, as shown in FIGS. 11A and 11B, when the sheet supply roller portions 2X, 2Y continue to be rotated, an uppermost recording sheet P rides over the separation pawl 3 to be separated from the other recording sheets. At the time when the separation operation of the separation pawl 3 is finished as shown in FIGS. 12A and 12B, the separated recording sheet is still inclined similar to the stacked recording sheets. After the separation operation of the separation pawl 3 is finished, the ribs 2d of the sheet supply roller portions 2X, 2Y start to contact with the recording sheet P, thereby establishing a separation condition that the sheet supply roller rubbers 2a are separated from the recording sheet P. Since the ribs 2d are integrally formed with the sheet supply roller of plastic material having low friction, a friction force between the recording sheet P being supplied and the recording sheets P stacked on the pressure plate 6 becomes greater than a friction force between the recording sheet P being supplied and the sheet supply roller, with the result that the recording sheet P being supplied is stopped by the difference between the friction forces. In the illustrated embodiment, the ribs 2d acts as both a separation means and a regulating means for regulating the movement of the recording sheet P.

Figure 13A:
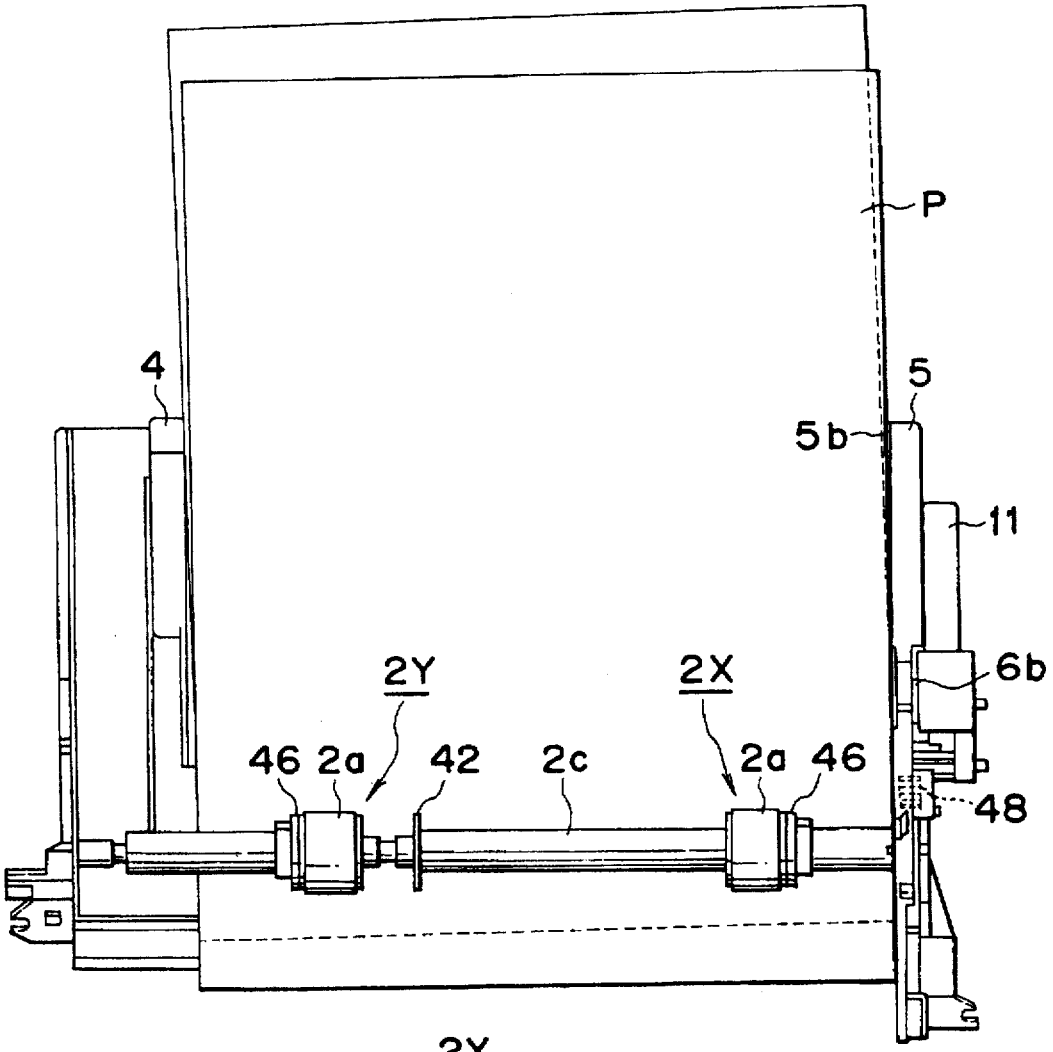
Figure 13B:
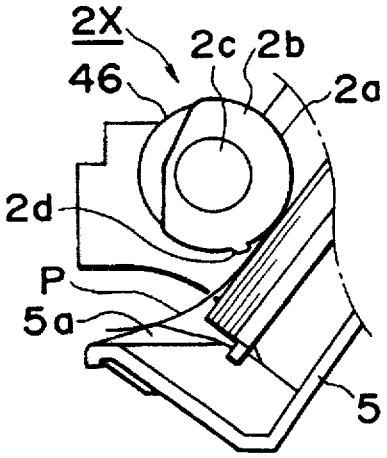

Since a distance between the recording sheet P and the separation area (rib) of the separation area of the sheet supply roller portion 2Y remote from the sheet reference is greater than a distance between the recording sheet P and the separation area of the sheet supply roller portion 2X near the sheet reference, as shown in FIGS. 13A and 13B, the recording sheet P being supplied is rotated around the sheet supply roller portion 2Y remote from the sheet reference, so that the edge (near the sheet reference) of the recording sheet P is abutted against the right side plate (sheet reference) 5b of the base 5. If the recording sheet P is inclined in an anti-clockwise direction until the recording sheet is spaced apart from the sheet supply roller rubber 2a, the recording sheet P is rotated in a clockwise direction due to the difference between the length of the separation areas of the roller portions 2b. When the edge (near the sheet reference) of the recording sheet P is abutted against the right side plate 5b of the base 5, a rotating force directing toward an anti-clockwise is generated, which rotating force overcomes the friction force between the recording sheet P being supplied and the recording sheet P stacked on the pressure plate 6, with the result that the recording sheet P is corrected to be directed in parallel to the sheet supplying direction while the roller portions 2b are being slipped.

On the other hand, if the recording sheet P is inclined in a clockwise direction until the recording sheet is spaced apart from the sheet supply roller rubber 2a, the recording sheet P is further rotated in a clockwise direction due to the difference between the length of the separation areas of the roller portions 2b. However, when the roller portions 2b reach their separation areas to bring the recording sheet P to the slipping condition, a force for rotating the side of the recording sheet near the right side plate 5b of the base 5 in the anti-clockwise direction is generated, which force overcomes the friction force between the recording sheet P stacked on the pressure plate 6 and the recording sheet P being supplied, with the result that the recording sheet P is corrected to be directed in parallel to the sheet supplying direction. Further, by hastening the timing for leaving the separation area of the roller portion 2b near the sheet reference from the recording sheet P more or less in comparison with the other roller portion 2b, the side of the recording sheet P near the sheet reference is prevented from being separated from the right side plate 5b due to the rotating force generated when the recording sheet is abutted against the right side plate 5b of the base 5.

As shown in FIGS. 10A and 10B, a gap t (about 1 mm) is generated by the inclination caused by supporting the recording sheets P only at one side near the separation pawl 3. A rotating amount of the recording sheet stack P required for making such gap to zero is calculated on the basis of said gap and a distance between two roller portions 2b. A difference in slipping amount between both roller portions 2b is determined from the calculated result.

Next, the controlling operation for the sheet supply portion 1 will be explained with reference to a flow chart shown in FIGS. 15A and 15B while referring to operating conditions shown in FIGS. 14A to 14E. The controlling operation for the sheet supply portion 1 can be effected when the sheet supply roller is positioned at the predetermined initial position or when the sheet supply roller is not positioned at the initial position (trouble condition). First of all, the controlling operation effected when the sheet supply roller is positioned at the predetermined initial position will be described.

In FIGS. 15A and 15B, when the sheet supply start signal is emitted, in a step S1, the drive switching arm 41 is shifted by shifting the carriage 26 thereby to permit the transmission of the driving force of the convey roller 14 to the sheet supply portion 1 (ASF position). Then, in a step S2, it is judged whether the sheet supply roller portions 2X, 2Y are in the initial position or not by checking the condition of the roller sensor 44. If the sheet supply roller portions 2X, 2Y are in the initial position (YES), the porgram goes to a step S3; whereas, if NO, the program goes to a step S26. If the sheet supply roller is positioned at the initial position, in the step S3, the sheet supply roller is rotated, and then, in a step S4, the edge of the sensor plate 42 is detected. By counting the number (N1) of the drive pulses of the LF motor 23 after the sensor plate is detected, the angular positons of the sheet supply roller portions 2X, 2Y are correctly monitored, thereby effecting the control with high accuracy.

When the sheet supply roller portions 2X, 2Y are rotated by about 60 degrees to face the cylindrical portions of the sheet supply roller rubber portions 2a with the recording sheet P, the releasing cam 12 rotated in synchronous with the sheet supply roller portions 2X, 2Y releases the pressure plate 6. Consequently, since the recording sheet P is urged against the roller rubber portions 2a by the biasing forces of the pressure plate springs 7, the conveying force for the recording sheet P is generated (refer to FIG. 14A). Then, in a step S6, the tip end of the recording sheet P to be conveyed is detected by the PE sensor 19. Then, in a step S7, the pulse count N1 of the LF motor when the tip end is detected is reserved as N2.

Then, in steps S8 and S9, it is judged that the condition is normal when (predetermined pulse X)<N2<(predetermined pulse Y). If the condition is normal, the program goes to a step S10, where the sheet supply roller portions 2X, 2Y are rotated up to the initial position where the cut-outs of the sheet supply roller portions are opposed to the recording sheet P. During this operation, since the push-down portion 6b of the pressure plate 6 is urged downwardly again by the releasing cam 12, the pressure plate 6 is released again (refer to FIG. 14B). When the rotation of the sheet supply roller portions 2X, 2Y is finished, the tip end of the recording sheet P has passed between the convey roller 14 and the pinch roller 15. In this case, the tip end position of the recording sheet P when the sheet supply roller portions 2X, 2Y are rotated up to the initial position is calculated by the drive pulse count N2.

Then, in a step S11, if the pulse count N2 is greater than predetermined pulse Z, it is judged that the tip end position of the recording sheet P is positioned at a downstream side of the nozzles of the recording head 24. Then, in a step S12, the carriage 26 is shifted, and, in a step S13, the LF motor 23 is rotated reversely to return the tip end of the recording sheet P to a position spaced apart from the convey roller 14 by 11.5 mm. The reverse rotation amount of the LF motor 23 is calculated from the pulse count N2. In this case, since the carriage 26 is shifted in the step S12, the drive switching arm 41 is also shifted, thereby preventing the driving force of the convey roller 14 from being transmitted to the sheet supply portion 1. Then, in a step S14, the convey roller 14 is rotated in the normal direction to eliminate the backlash in the gears and to convey the recording sheet P by 0.7 mm so that the recording sheet is positioned with the margin of 1.5 mm from the nozzles of the recording head 24 (refer to FIG. 14E). Then, the sheet supplying operation is ended.

Figure 14A:
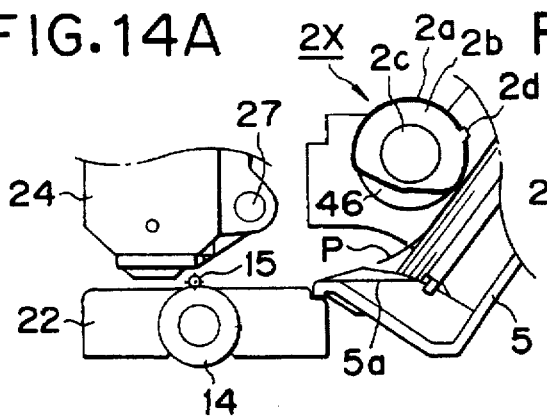
Figure 14D:
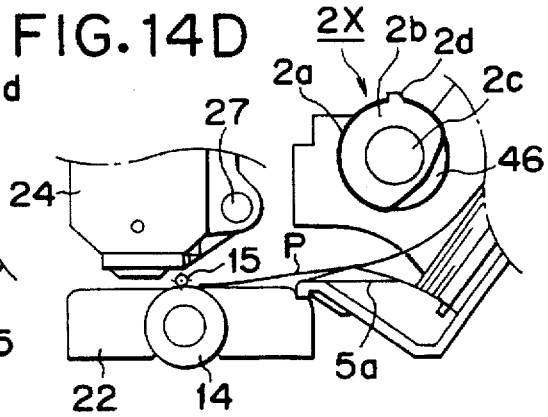
Figure 14B:
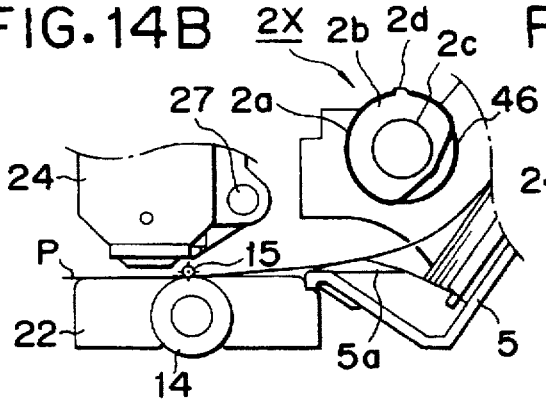
Figure 14E:
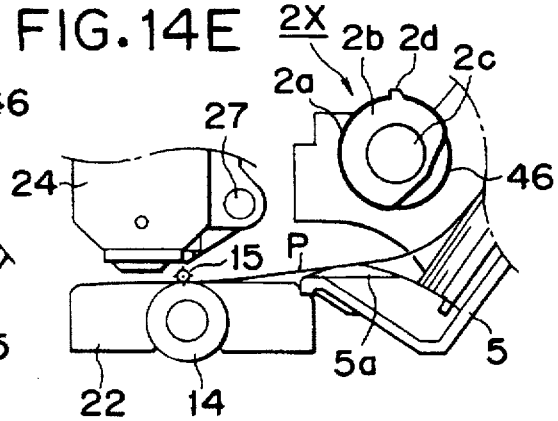
Figure 14C:
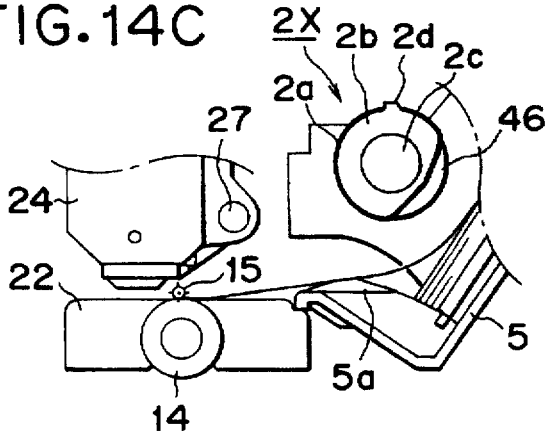
Figures 15, 15A:
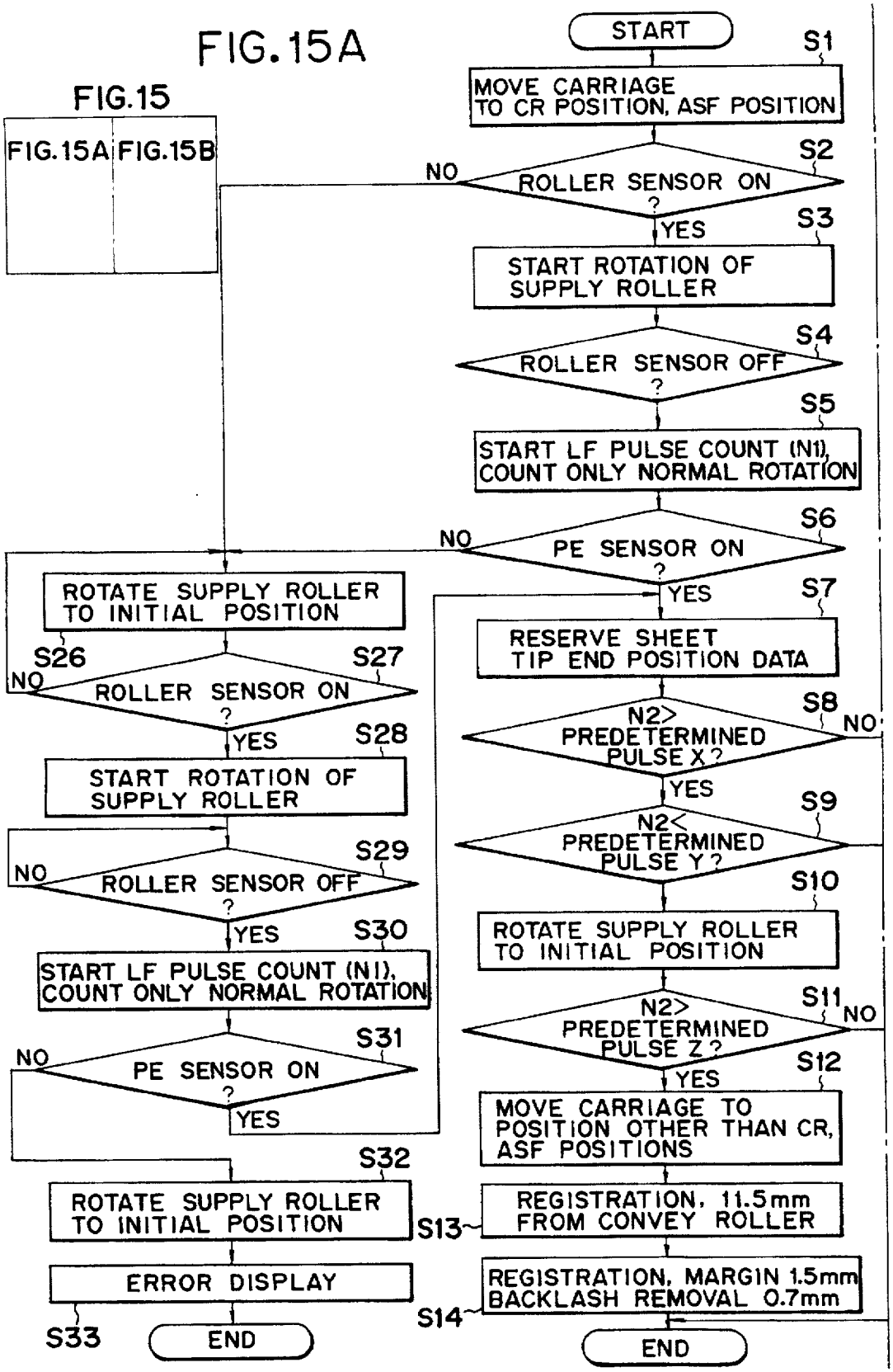
FIG. 15 is comprised of FIGS. 15A and 15B showing flow charts for explaining a control operation for the ink jet recording apparatus.
Figure 15B:
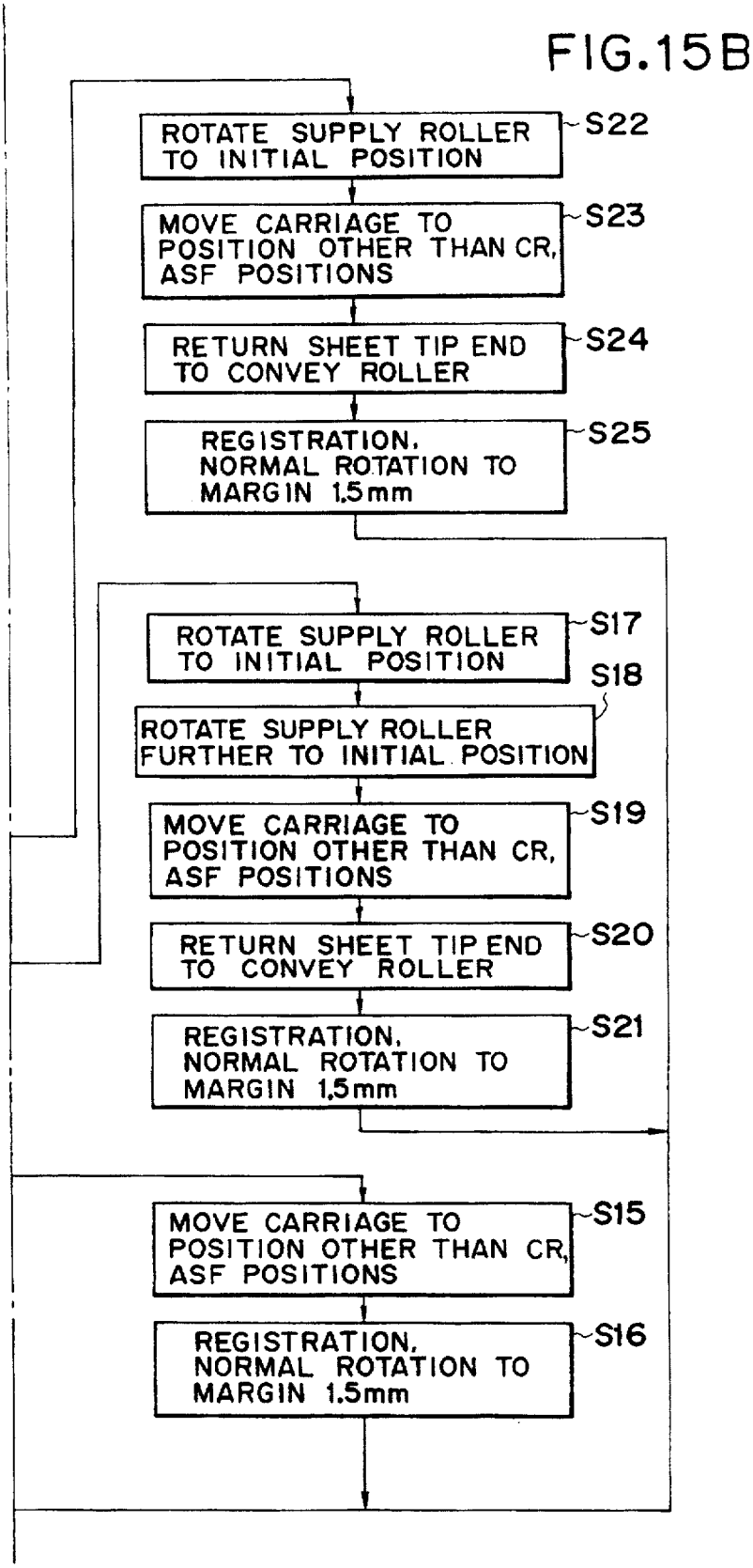

In the step S11, if the pulse count N2 is smaller than the predetermined pulse Z, it is judged that the tip end position of the recording sheet P is positioned at an upstream side of the nozzles of the recording head 24 (refer to FIG. 14D). Then, in a step S15, the carriage 26 is shifted. In this condition, by rotating the convey roller 14 in the reverse direction, the drive switching arm 41 is shifted, thereby preventing the driving force of the convey roller 14 from being transmitted to the sheet supply portion 1. Then, in a step S16, the convey roller 14 is rotated in the normal direction so that the recording sheet is positioned with the margin of 1.5 mm from the nozzles of the recording head 24 (refer to FIG. 14E). Then, the sheet supplying operation is ended.

On the other hand, in the step S9, if the pulse count (N2) of the LF motor when the tip end of the recording sheet is detected is greater than the predetermined pulse Y, it is judged that there arises a trouble condition that the slip is generated between the recording sheet P and the sheet supply roller portions 2X, 2Y to an extent that the tip end of the recording sheet P cannot reach the nip between the convey roller 14 and the pinch roller 15 only by one revolution of the sheet supply roller portions 2X, 2Y. Then, the program goes to a step S17.

In the step S17, the sheet supply roller portions 2X, 2Y are rotated up to the initial position, and, in a step S18, the sheet supply roller portions 2X, 2Y are further rotated by one revolution. Then, in a step S19, the carriage 26 is shifted. Then, in a step S20, the convey roller 14 is rotated in the reverse direction to return the tip end of the recording sheet P to the convey roller 14 (refer to FIG. 14C). The shifting movement of the carriage causes the drive switching arm 41 to shift, thereby preventing the driving force of the convey roller 14 from being transmitted to the sheet supply portion 1. Then, in a step S21, the convey roller 14 is rotated in the normal direction by a predetermined number of pulses so that the recording sheet is positioned with the margin of 1.5 mm from the nozzles of the recording head 24 (refer to FIG. 14E). Then, the sheet supplying operation is ended.

In the step S9, if the pulse count (N2) of the LF motor when the tip end of the recording sheet is detected is smaller than the predetermined pulse X, it is judged that there arises a trouble condition that the recording sheet P is shifted toward the downstream side before the sheet supplying operation is started, and the ribs **2*d* of the sheet supply roller portions 2X, 2Y are contacted with the recording sheet P to separate the sheet supply roller rubber portions 2*a* from the recording sheet P, thereby preventing the correct recognition of the tip end position of the recording sheet. Then, the program goes to a step S22**.

In the step S22, the sheet supply roller portions 2X, 2Y are rotated up to the initial position, and, in a step S23, the carriage 26 is shifted. Then, in a step S24, the convey roller 14 is rotated in the reverse direction to return the tip end of the recording sheet P to the convey roller 14 (refer to FIG. 14C). The shifting movement of the carriage causes the drive switching arm 41 to shift, thereby predriving for driving force of the convey roller 14 from being transmitted to the sheet supply portion 1. Then, in a step S25, the convey roller 14 is rotated in the normal direction by a predetermined number of pulses so that the recording sheet is positioned with the margin of 1.5 mm from the nozzles of the recording head 24 (refer to FIG. 14E). Then, the sheet supplying operation is ended.

In the step S6, if the PE sensor 19 is not turned ON, the program goes to a step S26, where the sheet supply roller portions 2X, 2Y are rotated up to the initial position, and, in a step S27, it is judged whether the roller sensor 44 is turned ON. If affirmative, the program goes to a step S28, where the sheet supply roller portions 2X, 2Y are rotated again. Then, in a step S29, if the edge of the sensor plate 42 is detected (roller sensor ON), the program goes to a step S30, where the number (N1) of the drive pulses of the LF motor 23 after the edge of the sensor plate is detected is counted, thereby correctly controlling the angular positions of the sheet supply roller portions 2X, 2Y. Then, in a step S31, if the tip end of the recording sheet P is detected (PE sensor ON), the program goes to the step S7. On the other hand, if the tip end is not detected, the program goes to a step S32, where the sheet supply roller portions 2X, 2Y are rotated up to the initial position and stopped there. Then, in a step S33, error display is presented. And then, the sheet supplying operation is ended.

With the arrangement as mentioned above, since the control for sheet supplying operation can be simplified and the construction of the recording apparatus is not limited, the automatic sheet feeding apparatus (ADF) can be applied to various kinds of recording apparatuses. Further, since the construction of the sheet supply portion can be simplified, the number of parts can be reduced. In addition, the recording sheet can be supplied from the ADF to the recording portion for a very short time, thereby achieving the high speed recording.

(Second Embodiment)

Figure 16:
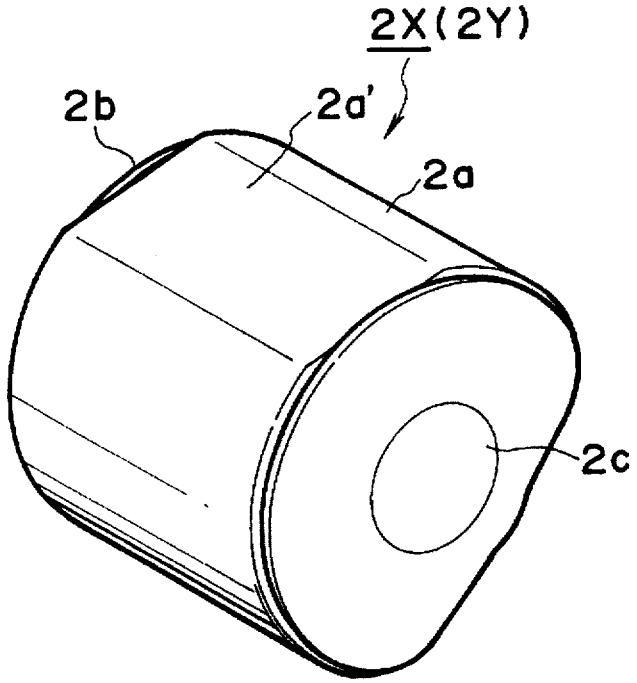
FIG. 16 is a perspective view of a sheet supply roller according to a second embodiment.
Figure 17:
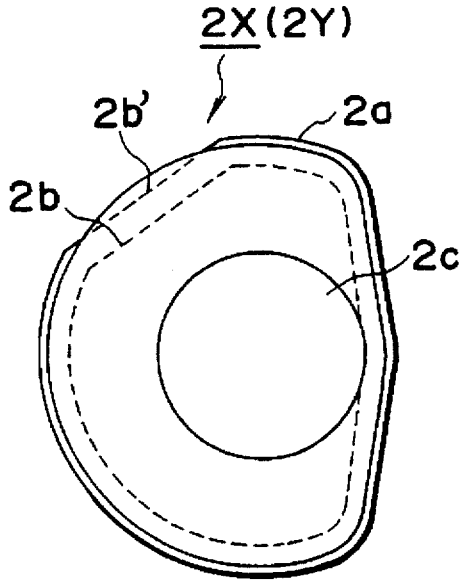
FIG. 17 is a side view of the sheet supply roller of FIG. 16.

In the first embodiment, while the separation areas of the roller portions **2*b* of the sheet supply roller portions 2X, 2Y were defined by the ribs 2*d* having the radius greater than those of the roller rubber portions 2*a* and formed on the roller portions 2*b* having smaller coefficient of friction than the roller rubber portion 2*a*, as shown in FIGS. 16 and 17, in place of the ribs 2*d*, a cut-out 2*a*' may be formed on the roller rubber 2*a* or an arcuate portion 2*b*' of the roller portion 2*b*** may be cut. In this case, the same advantage as the first embodiment can be achieved.

(Third Embodiment)

Figure 18:
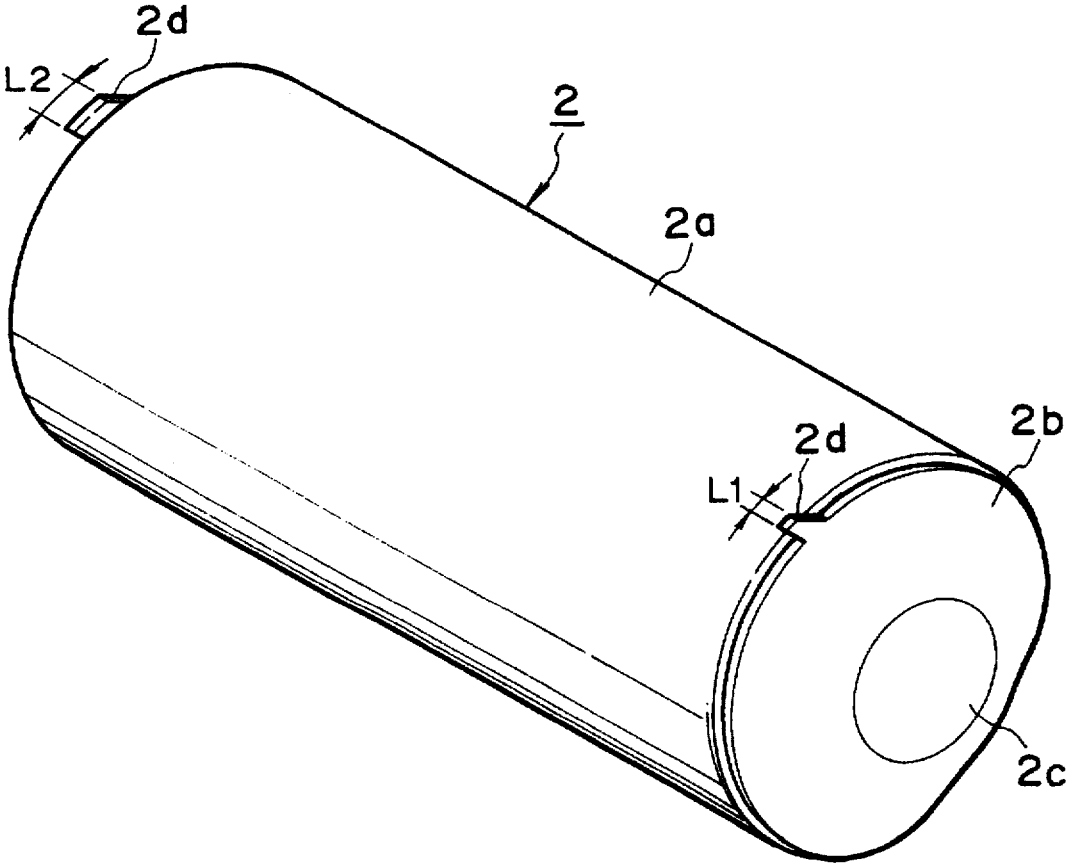
FIG. 18 is a perspective view of a sheet supply roller according to a third embodiment.

In the first embodiment, while an example that two roller portions **2*b* formed on the shaft portion 2*c* are used was explained, as shown in FIG. 18, a single sheet supply roller 2 comprising a single roller portion 2*b* formed on a shaft portion 2*c* and having ribs 2*d* at its both longitudinal ends may be used. In this case, the ribs 2*b* are protruded from the roller portion 2*b* in a radial direction, and circumferential lengths (L1, L2) of the ribs 2*d*** differ from each other. Also in this case, the same advantage as the first embodiment can be achieved.

(Fourth Embodiment)

Figure 19A:
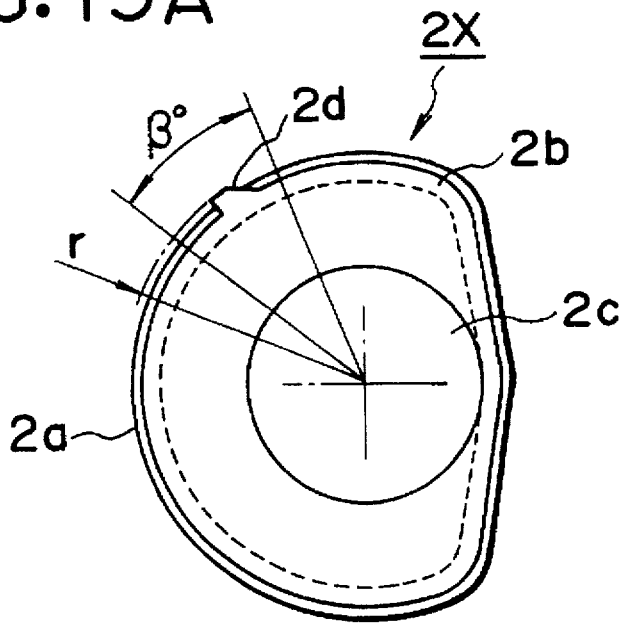
FIGS. 19A and 19B are side views of a sheet supply roller according to a fourth embodiment.
Figure 19B:
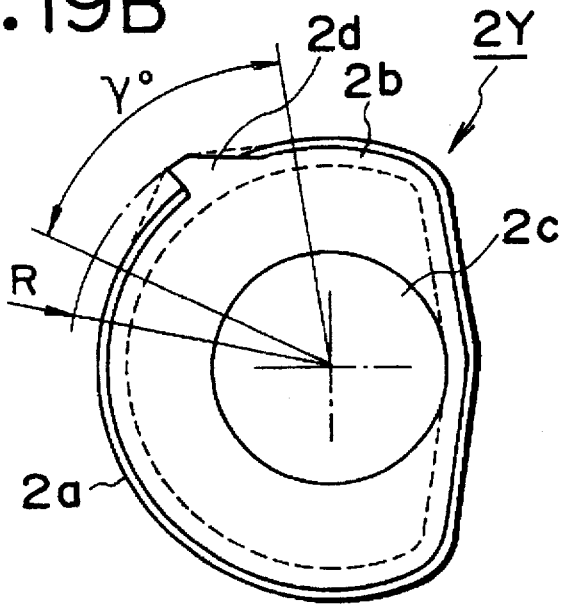

Further, as shown in FIGS. 19A and 19B, by differentiating a radial distance of the rib **2*d* of the sheet supply roller portion 2X (from the center of the shaft portion 2*c*) from a radial distance of the rib 2*d* of the sheet supply roller portion 2Y**, the widths of the separation areas can be differentiated from each other, thereby achieving the same advantage as the first embodiment.

(Fifth Embodiment)

Figure 20:
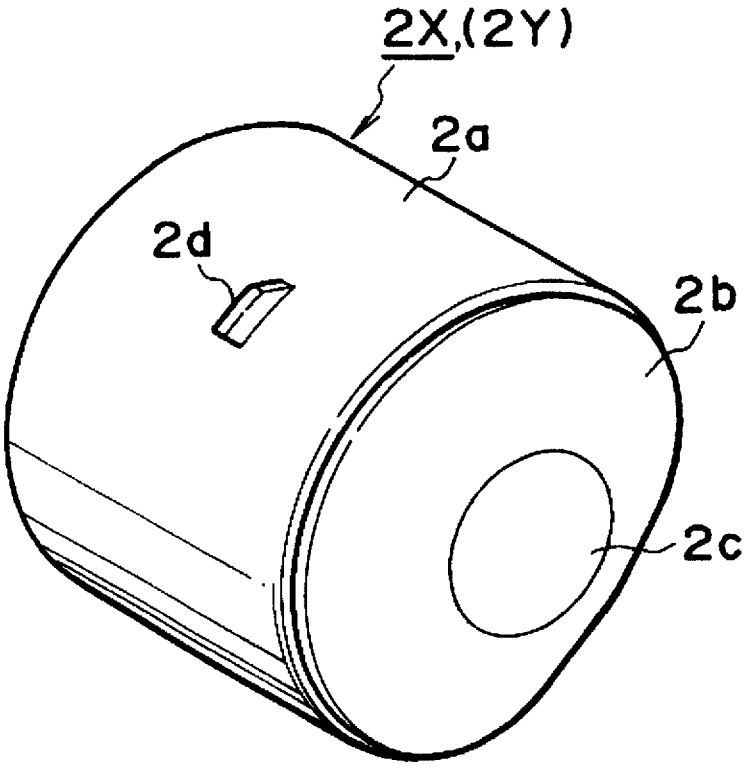
FIG. 20 is a perspective view of a sheet supply roller according to a fifth embodiment.

The ribs **2*d* protruded from the roller portions 2*b* of the sheet supply roller portions 2X, 2Y are not necessarily formed on both longitudinal ends of each roller portion, but, as shown in FIG. 20, a rib 2*d* may be a central portion of each roller portion 2*b*. In this case, it is necessary to form an opening in the corresponding roller rubber 2*a*, through which the rib 2*d* can be protruded. Further, the rib or ribs 2*d* may be formed independently from the roller portion 2*b*** and be attached to the roller portion.

(Sixth Embodiment)

Figure 21A:
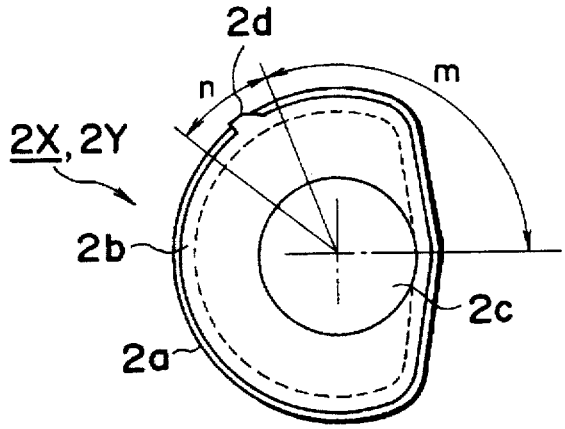
FIG. 21A is a perspective view of a sheet supply roller according to a sixth embodiment.
Figure 21B:
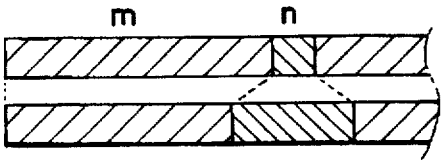
FIGS. 21B to 21F are timing chart for the sheet supply roller of FIG. 21A.
Figure 21C:
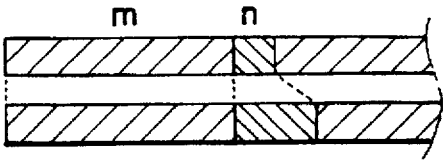
Figure 21D:
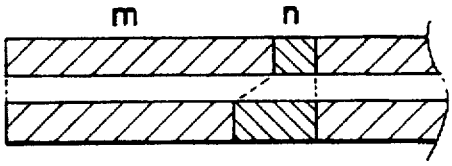

FIGS. 21A to 21F are explanatory views when the separation area setting position of the sheet supply roller portion 2X are differentiated from that of the sheet supply roller portion 2Y. In the first embodiment, as shown in FIG. 21B, it was so designed that the separation area of the sheet supply roller portion 2Y remote from the sheet reference reaches the recording sheet P faster than the separation area of the other sheet supply roller portion 2X and leaves the recording sheet later than the separation area of the other sheet supply roller portion. However, depending upon the kind of sheet feeding apparatuses, as shown in FIG. 21C, it may be designed so that the separation area of the sheet supply roller portion 2Y remote from the sheet reference reaches the recording sheet P simultaneously with the separation area of the other sheet supply roller portion 2X and leaves the recording sheet later than the separation area of the other sheet supply roller portion, or, as shown in FIG. 21D, it may be designed so that the separation area of the sheet supply roller portion 2Y remote from the sheet reference reaches the recording sheet P faster than the separation area of the other sheet supply roller portion 2X and leaves the recording sheet simultaneously with the separation area of the other sheet supply roller portion. In these cases, an advantage superior to that of the first embodiment may be achieved.

Figure 21E:
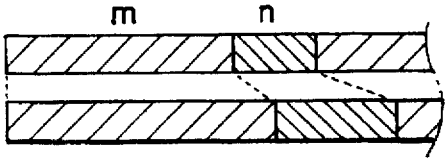
Figure 22A:
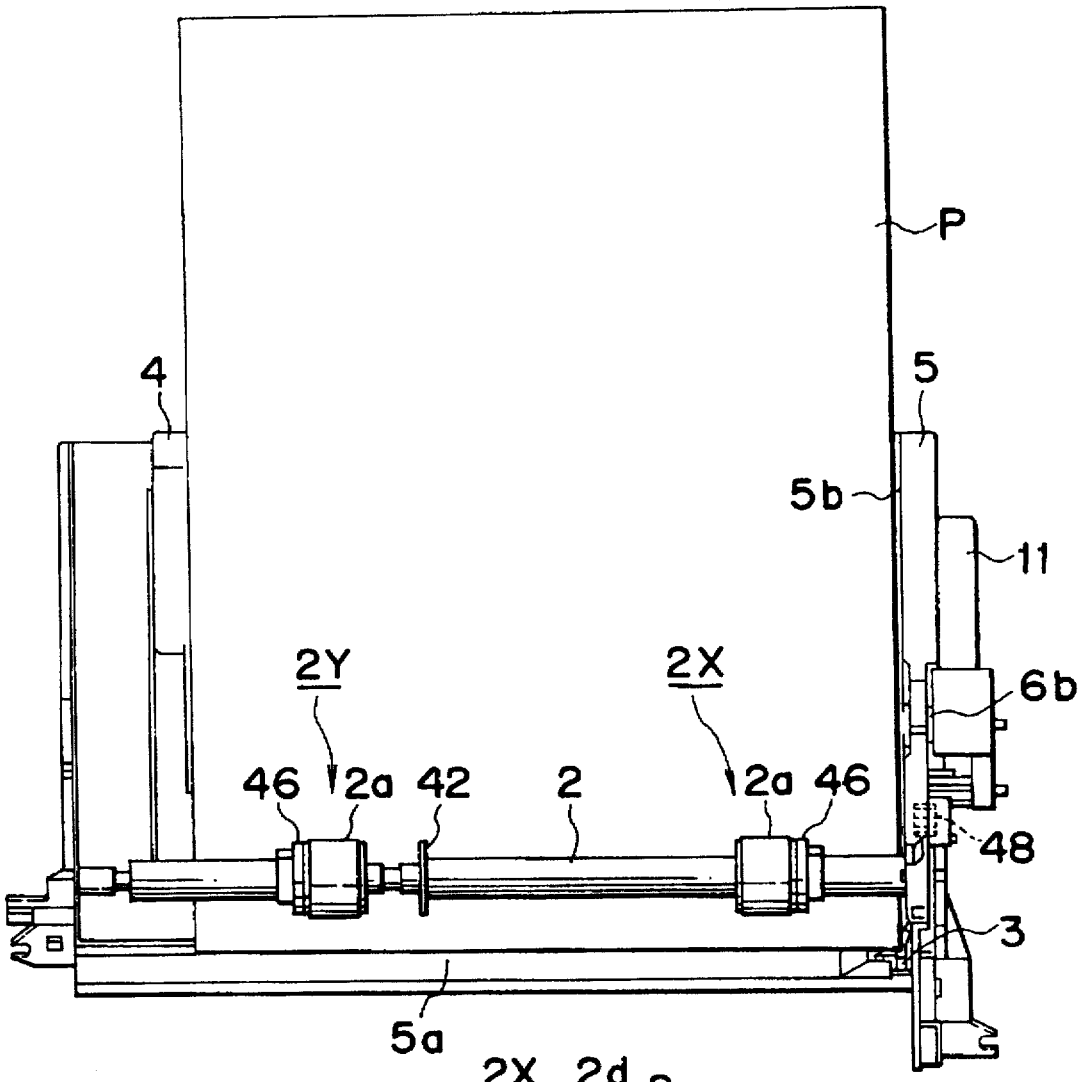
FIGS. 22A, 22B, 23A, 23B, 24A and 24B are views for explaining a sheet supplying operation according to the sixth embodiment.
Figure 22B:
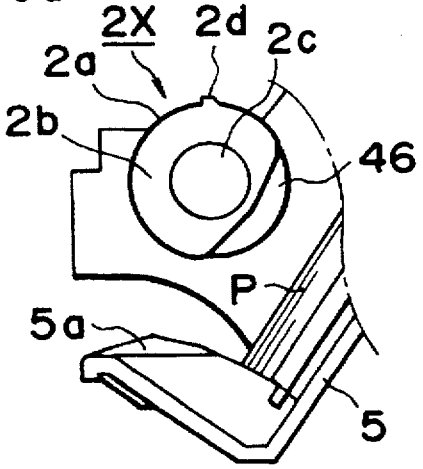
Figure 23A:
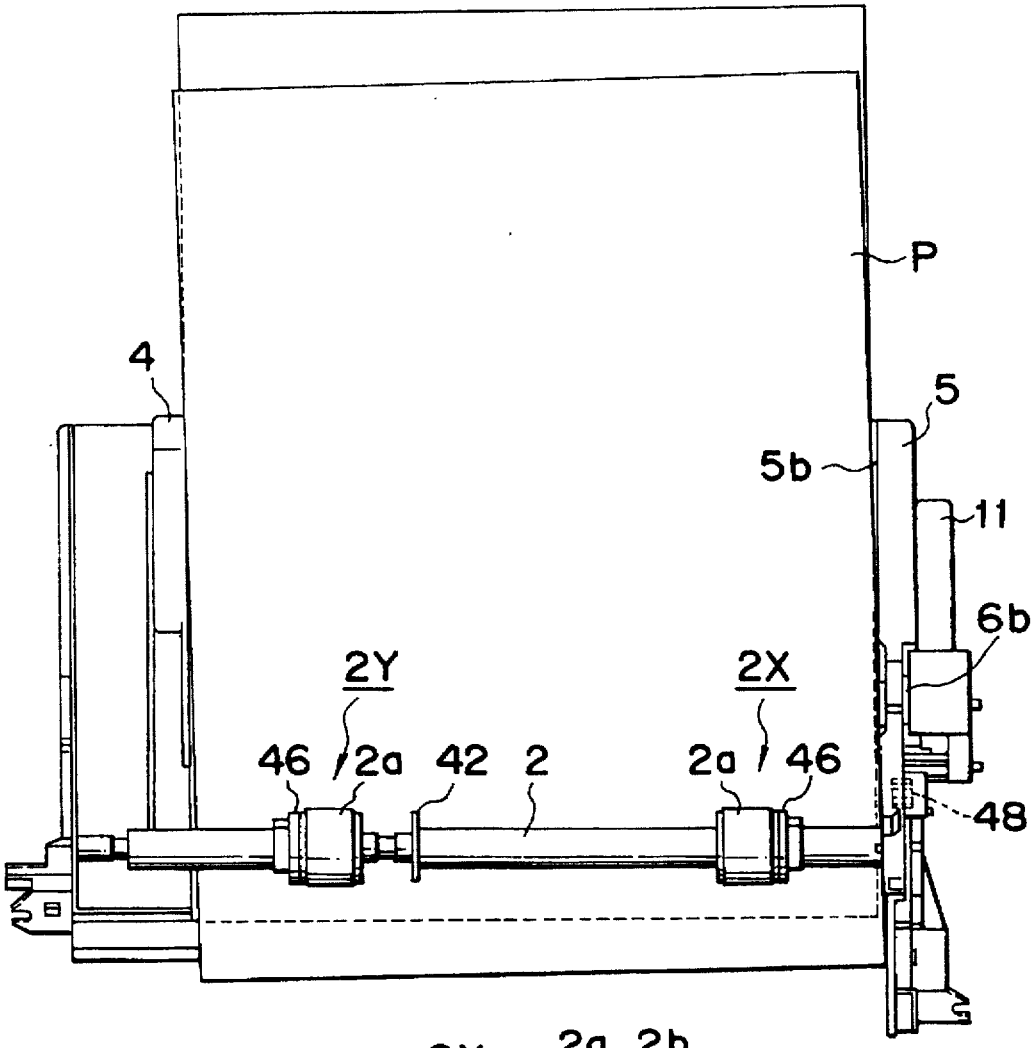
Figure 23B:
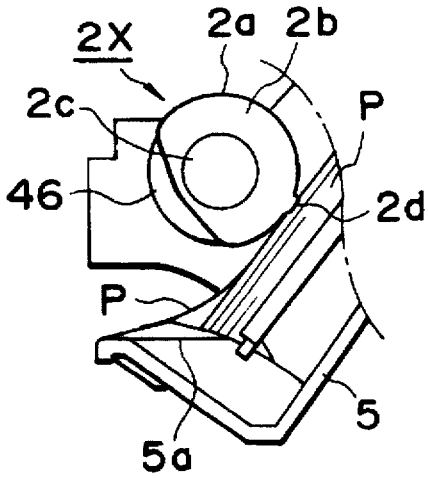
Figure 24A:
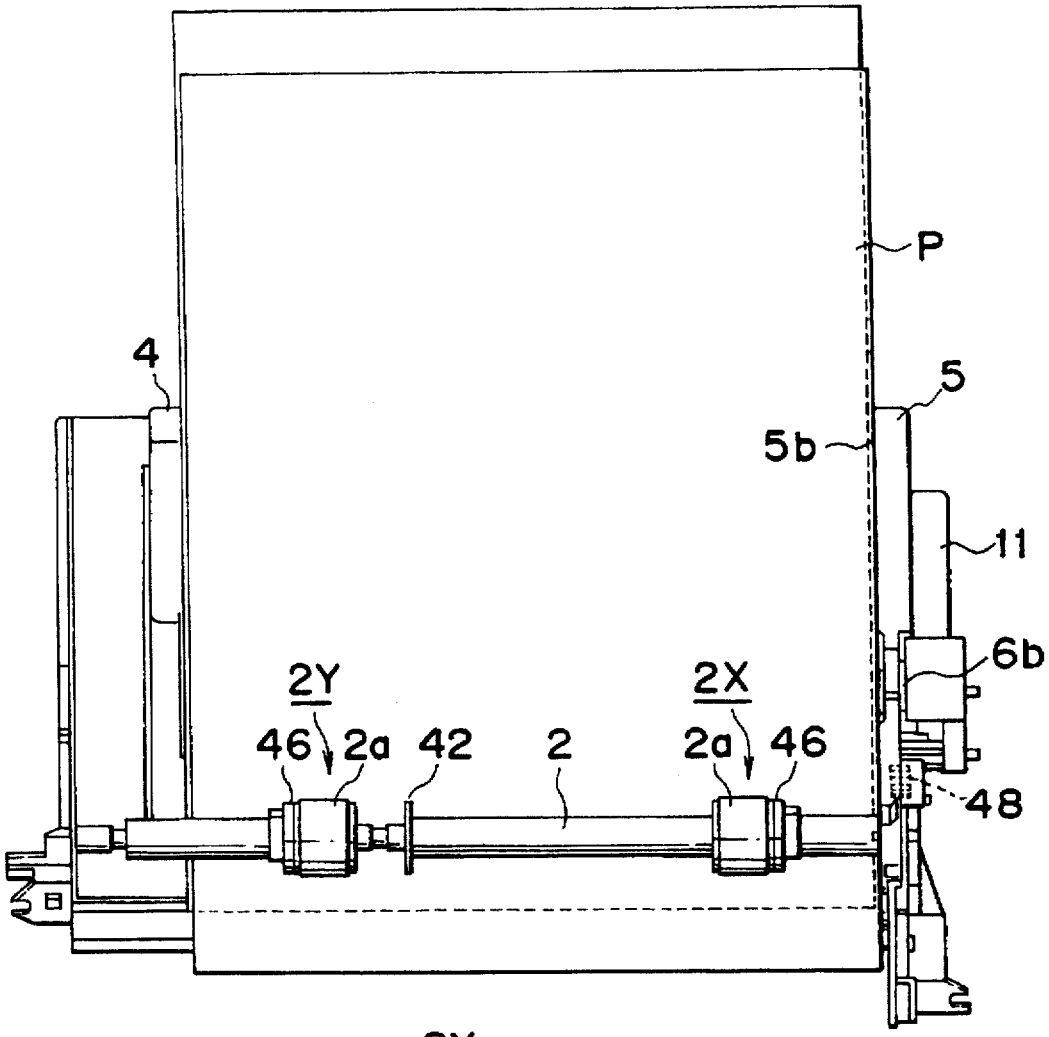
Figure 24B:
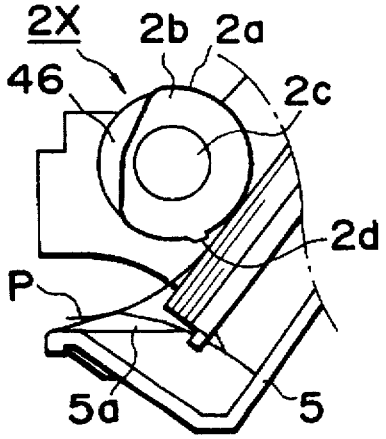

Incidentally, FIG. 21E shows a case where the separation area of the sheet supply roller portion 2X near the sheet reference reaches the recording sheet P faster than the separation area of the other sheet supply roller portion 2Y and leaves the recording sheet faster than the separation area of the other sheet supply roller portion. In this case, as shown in FIGS. 22A to 24B, an advantage can be achieved when the recording sheets P are stacked on the pressure plate in such a condition that the sides of the recording sheets near the sheet reference are spaced apart from the right side plate 5*b* of the base 5. More particularly, as shown in FIGS. 22A and 22B, when the recording sheets P are stacked in the condition that the sides of the recording sheets near the sheet reference are spaced apart from the right side plate 5*b* of the base 5, since the separation area of the sheet supply roller portion 2X near the sheet reference firstly reaches the recording sheet P, as shown in FIGS. 23A and 23B, the recording sheet P is rotated in the anti-clockwise direction, thereby abutting the front corner of the recording sheet near the sheet reference against the right side plate 5*b* of the base 5. Thereafter, in a zone where only the separation area of the sheet supply roller portion 2Y remote from the sheet reference is opposed to the recording sheet P, as shown in FIGS. 24A and 24B, the recording sheet P is rotated in the clockwise direction, thereby abutting the rear corner of the recording sheet near the sheet reference against the right side plate 5*b* of the base 5. In this way, the entire side edge of the recording sheet P near the sheet reference is abutted against the right side plate 5*b*, thereby positioning the recording sheet in parallel with the sheet supplying direction.

Figure 21F:
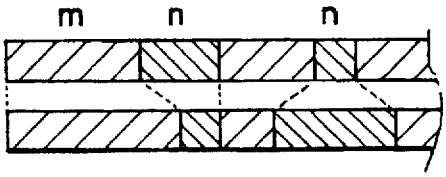

FIG. 21F shows a case where there are provided two sheet supply roller portions 2X near the sheet reference and two sheet supply roller portions 2Y remote from the sheet reference. In this case, it is designed so that the separation area of the sheet supply roller portion 2X nearest to the sheet reference reaches the recording sheet faster than the separation area of the sheet supply roller portion 2Y furthest from the sheet reference and leaves the recording sheet simultaneously with the separation area of the sheet supply roller portion 2Y furthest from the sheet reference to rotate the recording sheet P in the anti-clockwise direction, thereby abutting the front corner of the recording sheet near the sheet reference against the right side plate 5*b*. Further, it is so designed that, thereafter, the separation area of the other sheet supply roller portion 2Y remote from the sheet reference reaches the recording sheet faster than the separation area of the other sheet supply roller portion 2X near the sheet reference and leaves the recording sheet later than the separation area of the other sheet supply roller portion 2X near the sheet reference. With this arrangement, the recording sheet is then rotated in the clockwise direction to abut the entire side edge of the recording sheet near the sheet reference against the right side plate 5*b*.

(Seventh Embodiment)

FIGS. 25A, 25B, 26A, 26B, 27A, 27B, 28A and 28B show an embodiment wherein, after the tip end of the recording sheet P was released from the separation means, the sheet supply roller portions 2X, 2Y are completely released from the recording sheet P by utilizing the separation areas of the sheet supply roller portions 2X, 2Y, and wherein there is provided a regulation means for regulating the movement of the recording sheet P toward the sheet supplying direction in the above-mentioned released condition.

Figure 25A:
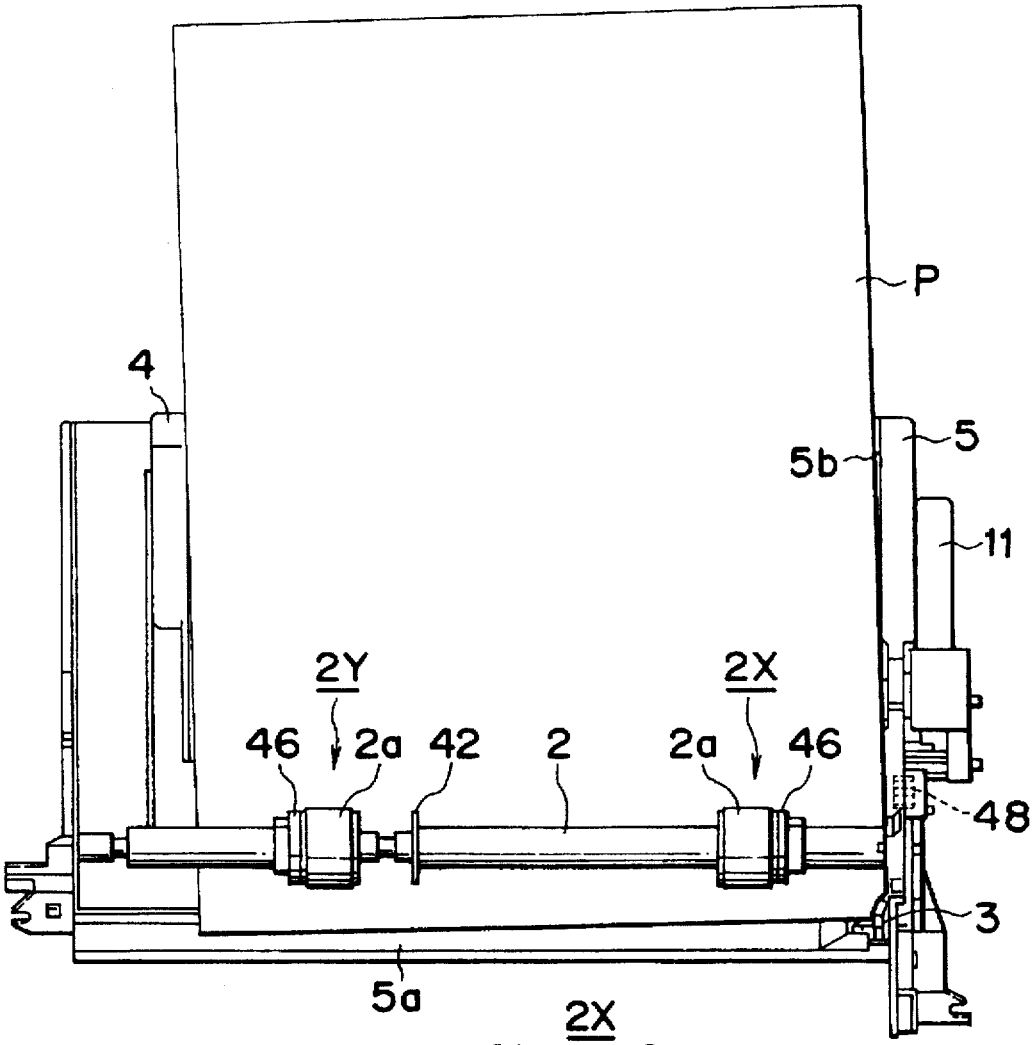
FIGS. 25A, 25B, 26A, 26B, 27A, 27B, 28A and 28B are views for explaining a sheet supplying operation according to a seventh embodiment.
Figure 25B:
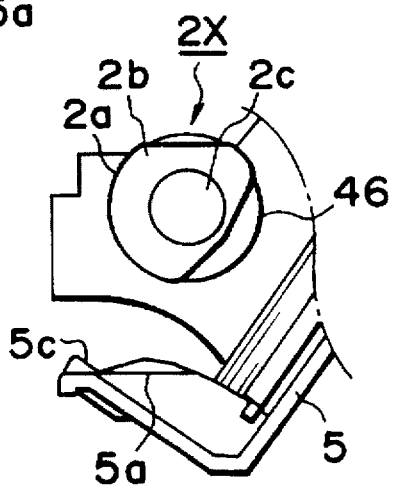
Figure 26A:
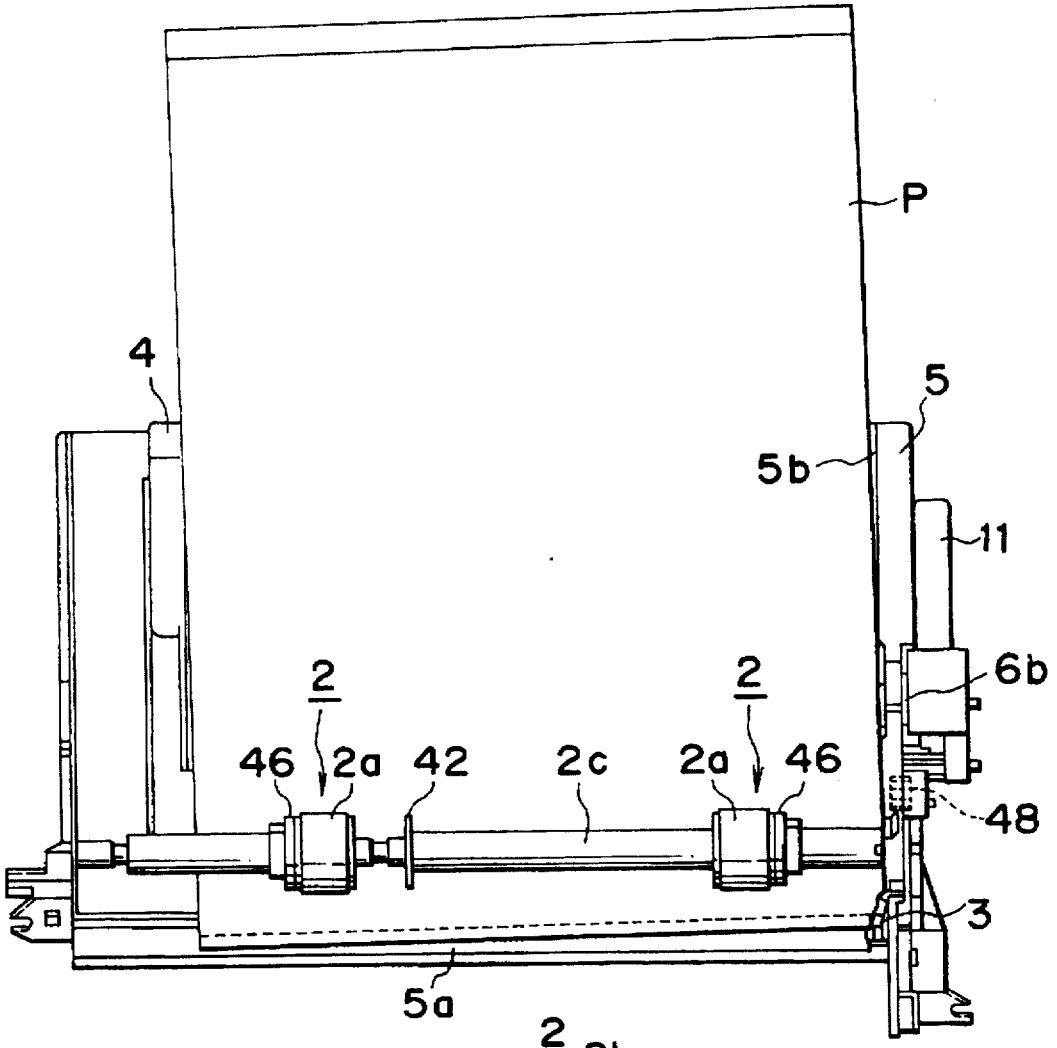
Figure 26B:
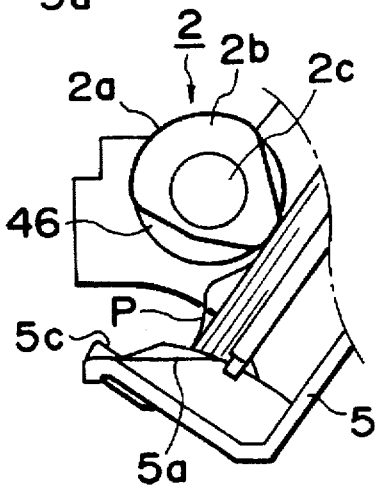
Figure 27A:
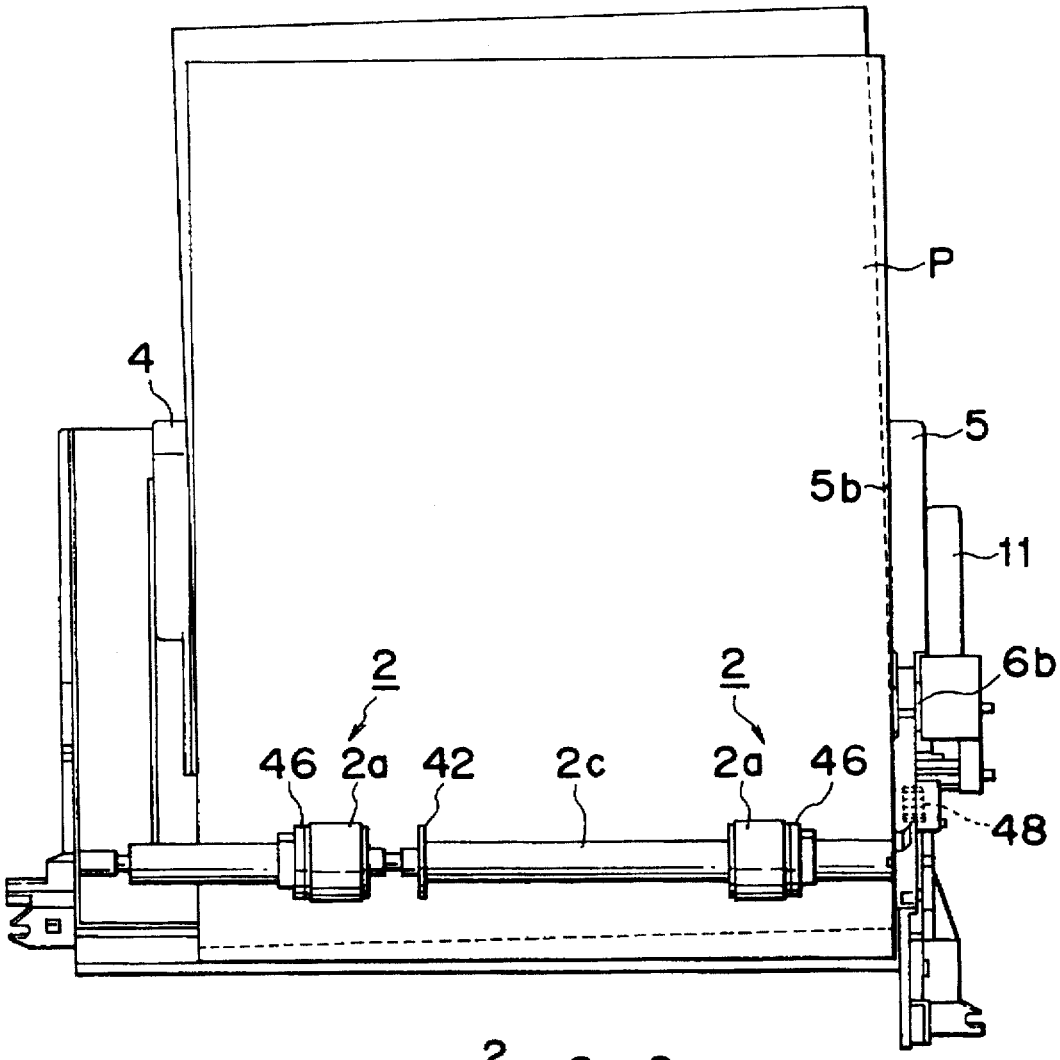
Figure 27B:
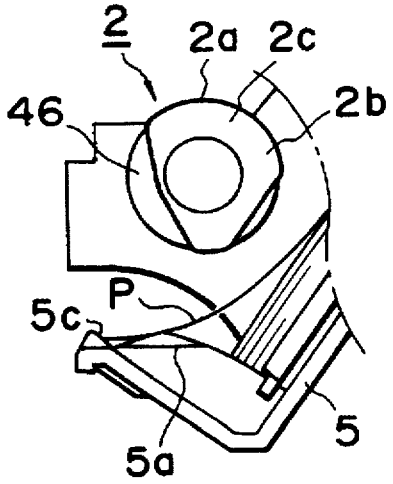
Figure 28A:
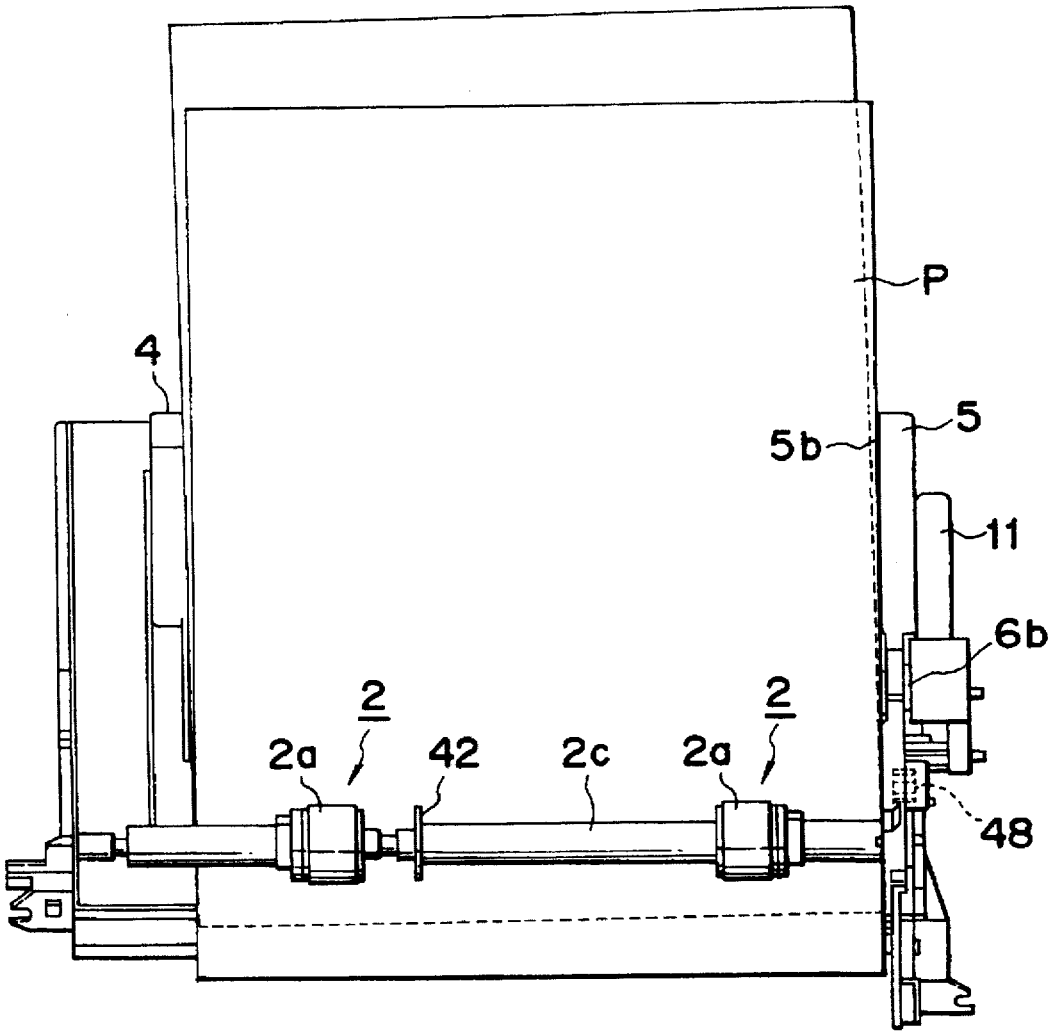
Figure 28B:
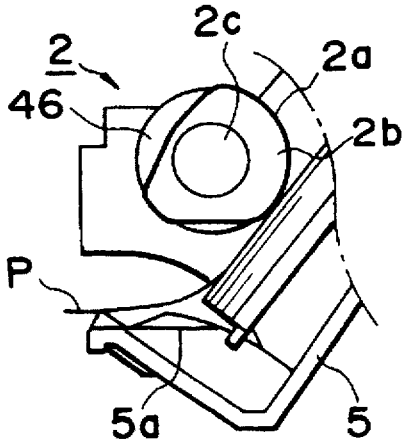

In FIGS. 25A and 25B, when the sheet supplying operation is started, a loop is formed in the uppermost recording sheet P among the sheet stack rested on the pressure plate as shown in FIGS. 26A and 26B, thereby starting the separation of the uppermost recording sheet P from the separation pawl 3 regulating the front corner of the recording sheet. In FIGS. 27A and 27B, after the recording sheet is released from the separation pawl 3, the separated recording sheet P is shifted along the inclination of the base 5 toward the downstream side by contacting with the separation areas of the sheet supply roller portions 2X, 2Y and then by being separated from the sheet supply roller portions 2X, 2Y by means of a release means (not shown), with the result that the tip end of the recording sheet is abutted against an inclined surface 5*c* of a projection formed on an tip end of the lower guide portion 5*a*, thereby correcting the direction of the recording sheet in parallel with the sheet supplying direction. From this condition, as shown in FIGS. 28A and 28B, when the separation areas of the sheet supply roller portions 2X, 2Y leaves the recording sheet and the released condition is finished, the corrected recording sheet P is supplied again toward the downstream side by means of the sheet supply roller portions 2X, 2Y.

(Eighth Embodiment)

Figure 29A:
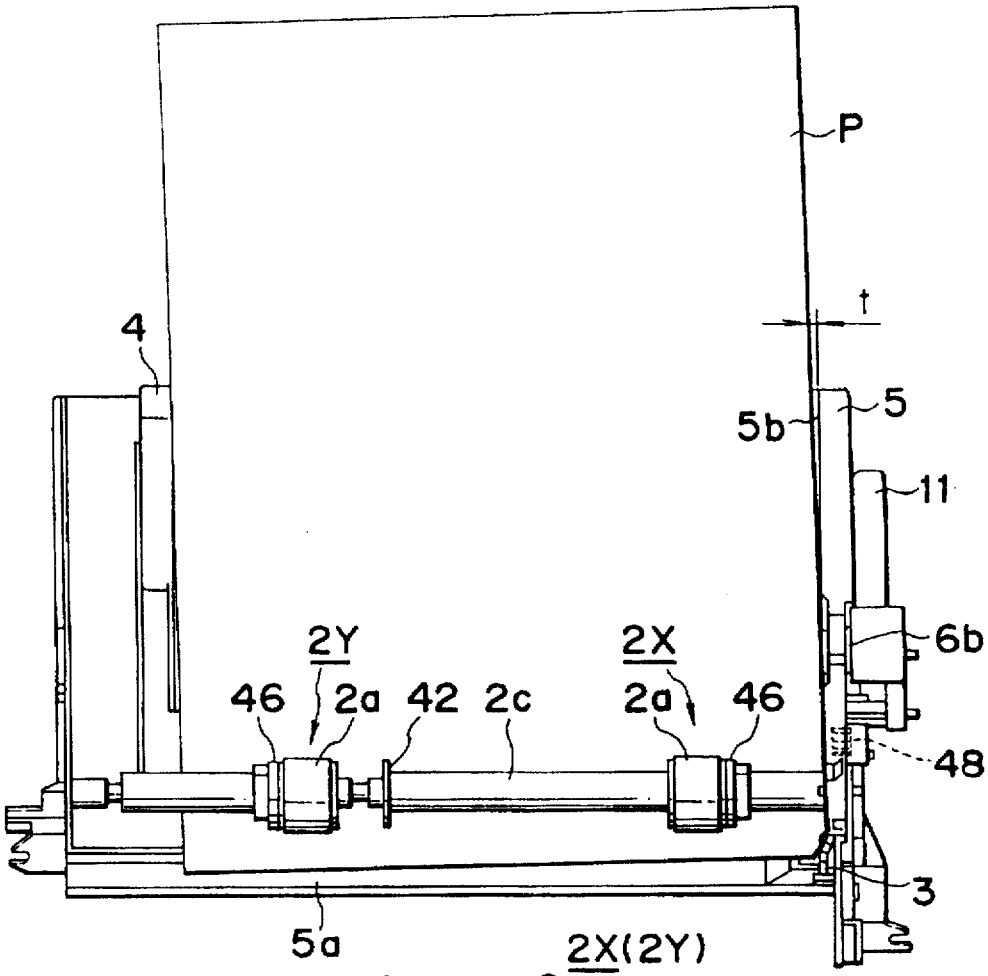
FIGS. 29A, 29B, 30A, 30B, 31A and 31B are views for explaining a sheet supplying operation according to an eighth embodiment.
Figure 29B:
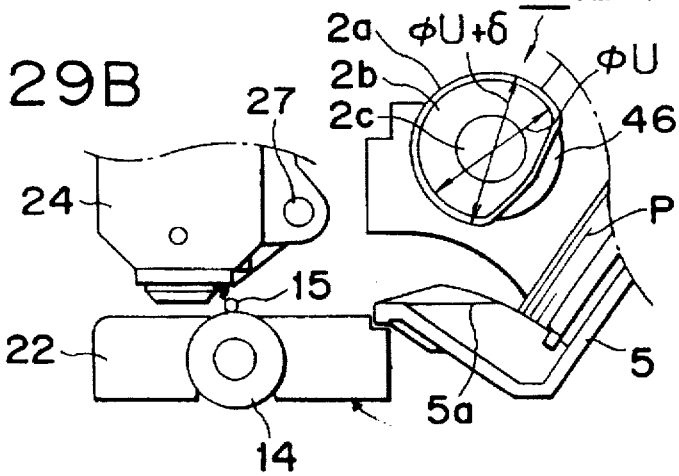

In FIGS. 29A and 29B, as is in the first embodiment, the sheet supply roller comprises two sheet supply roller portions 2X, 2Y (2*b*) secured to a shaft portion 2*c* in such a manner that the roller portions 2X, 2Y are spaced apart from a sheet reference by about 40 mm and 170 mm, respectively. Accordingly, the recording sheet P such as A4 size sheet is conveyed by the two sheet supply roller portions 2X, 2Y, and the recording sheet such as a post card is conveyed by the single roller portion 2X near the sheet reference. Further, as shown in FIGS. 29A and 29B, a diameter ($\phi U+\delta$) of a sheet supply roller rubber 2*a* of the sheet supply roller portion 2X near the sheet reference is greater than a diameter ($\phi U$) of a sheet supply roller rubber 2*a* of the sheet supply roller portion 2Y remote from the sheet references by $\delta$($\delta/2$ regarding a radius).

Next, a process for stabilizing the sheet supplying condition by using the difference in diameter between the sheet supply roller rubber portions 2*a* of the sheet supply roller portions 2X, 2Y will be explained. First of all, if the separation pawl 3 for regulating the front corner of the recording sheet P is arranged only at one side of the pressure plate in the sheet supply portion 1, as shown in FIGS. 29A and 29B, the stacked recording sheets P are apt to be lowered around the separation pawl 3 toward a side where the separation pawl does not exist. In this case, the inclination of the recording sheet P is such that a gap t (=about 1 mm) is created between the side edge of the recording sheet and the right side plate 5*b* of the base 5 at a rear end of the right side plate spaced apart from the center of the shaft portion 2*c* by 131.5 mm in the sheet supplying direction. From this condition, the sheet supply roller portions 2X, 2Y start to be rotated and the recording sheets P supported by the pressure plate 6 are urged against the sheet supply roller rubber portions 2*a* of the sheet supply roller, thereby starting the sheet supplying operation.

Figure 30A:
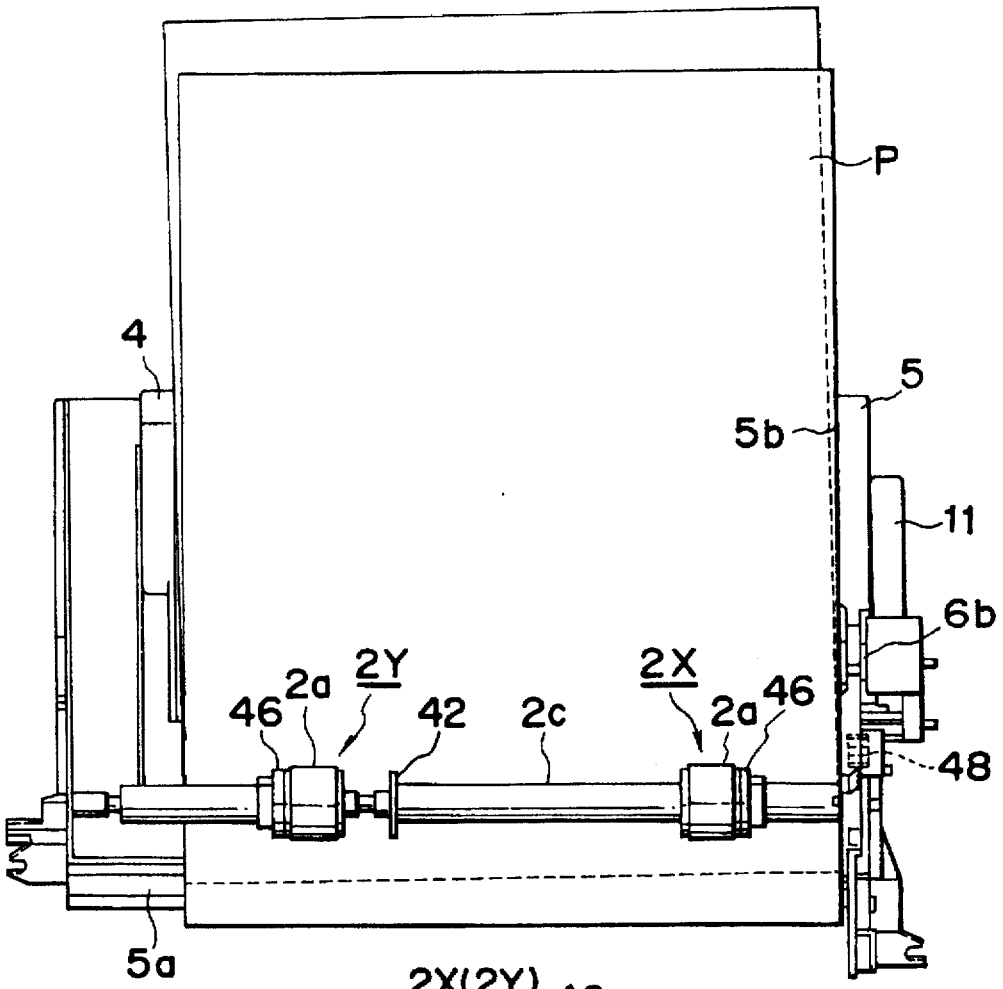
Figure 30B:
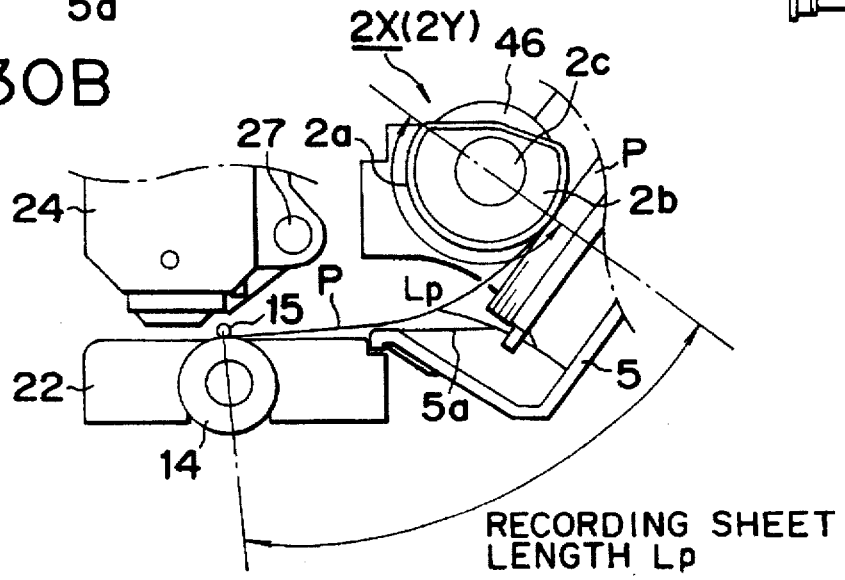

Since the diameter of the sheet supply roller portion 2X near the sheet reference is greater than that of the sheet supply roller portion 2Y remote from the sheet reference, the recording sheet P is conveyed from the upstream side to the downstream side, and, at the same time, the tip end of the recording sheet P is rotated in the clockwise direction. In this case, as shown in FIGS. 30A and 30B, a rotation angle of the sheet supply roller portions 2X, 2Y required for conveying the recording sheet P by a recording sheet path length Lp from a sheet supply starting point to the nip between the convey roller 14 and the pinch roller 15 is calculated, and the difference δ in diameter between the sheet supply roller portions 2X, 2Y are selected so that the gap t between the recording sheet P and the right side plate 5*b* can be eliminated during the sheet supply roller portions 2X, 2Y are rotated by the calculated rotation angle. In the illustrated embodiment, the diameter of the sheet supply roller rubber 2*a* near the sheet reference was set to 24.7 mm, the diameter of the sheet supply roller rubber 2*a* remote from the sheet reference was set to 24.0 mm, and the difference δ was set to 0.7 mm.

Under the above-mentioned action, before the sheet supplying operation is started, the front corner of the recording sheet P remote from the separation pawl 3 is advanced toward the downstream side of the sheet feeding direction in comparison with the front corner of the recording sheet P near the separation pawl 3. However, after the sheet supplying operation is started by rotating the sheet supply roller portions 2X, 2Y, when the tip end of the recording sheet P reaches the nip between the convey roller 14 and the pinch roller 15, both front corners of the recording sheet P reach the nip substantially simultaneously.

Figure 31A:
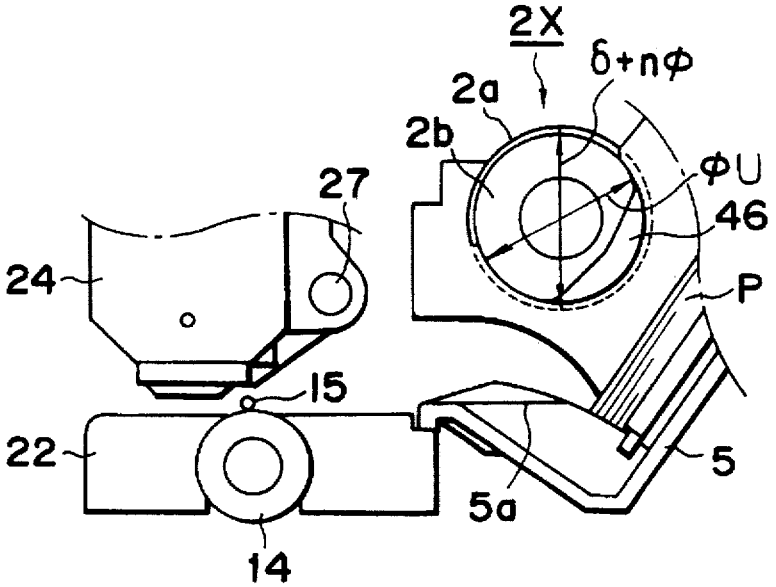
Figure 31B:
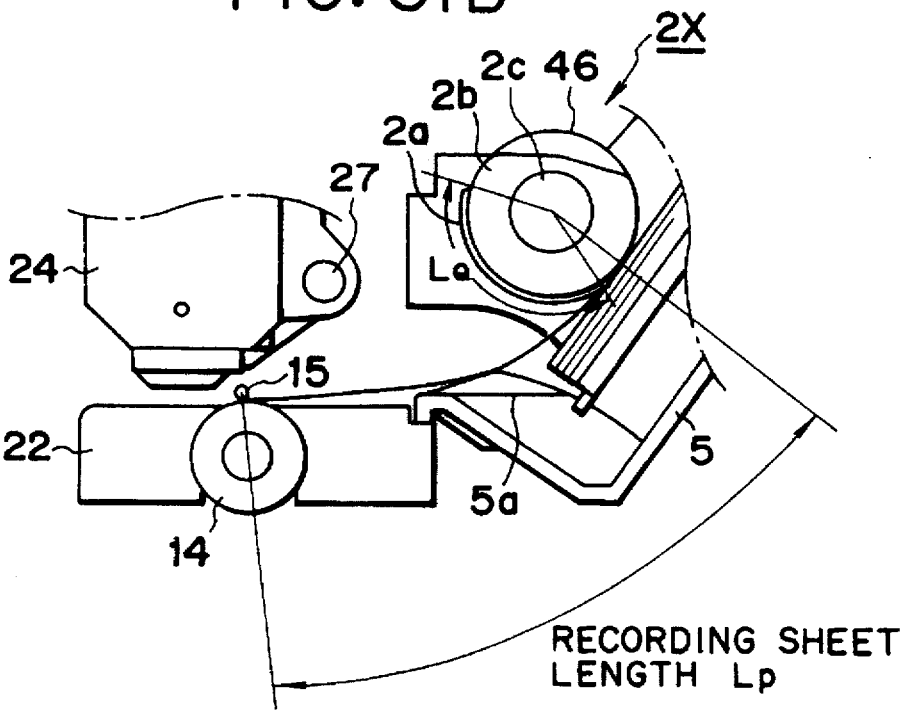
Figure 32A:
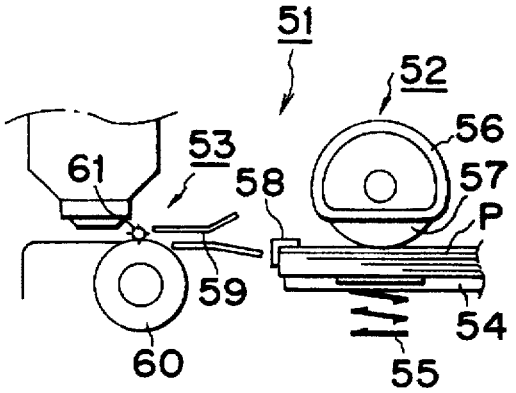
FIG. 32A PRIOR ART
FIGS. 32A to 32E are views for explaining a conventional sheet feeding apparatus.
Figure 32D:
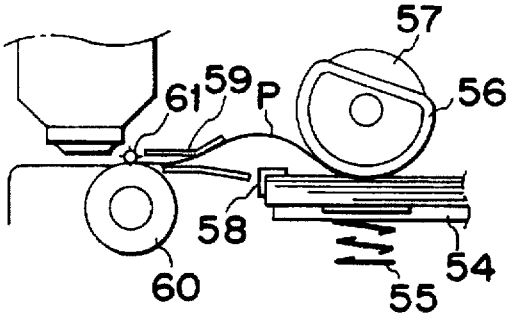
FIG. 32D PRIOR ART
Figure 32B:
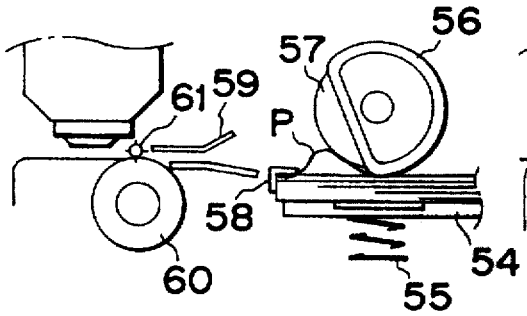
FIG. 32B PRIOR ART
Figure 32E:
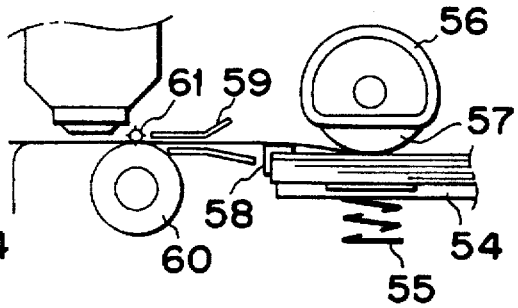
FIG. 32E PRIOR ART
Figure 32C:
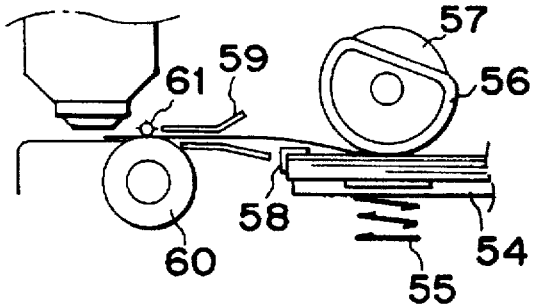
FIG. 32C PRIOR ART

In the eighth embodiment, while an example that the diameter of the roller rubber 2*a* near the sheet reference is greater than that of the roller rubber 2*a* remote from the sheet reference was explained, as shown in FIGS. 31A and 31B, a large diameter portion ($L_Q$) may be provided on the roller rubber 2*a* within the rotation angle range $L_P$ of the sheet supply roller portion 2X required for conveying the recording sheet P to the nip between the convey roller 14 and the pinch roller 15 ($L_P > L_Q$). Also in this case, a diameter of the large diameter portion ($L_Q$) of the roller rubber 2*a* is selected to provide desired difference in diameter between the roller rubber portions 2*a*. Since a process for stabilizing the sheet supplying condition by utilizing the separation areas in the sheet supply portion is the same as that of the first embodiment, explanation thereof will be omitted.

Incidentally, in the aforementioned embodiments, while an example that the sheet supply portion 1 is of pawl separation type wherein only one front corner of the recording sheet P is regulated by the separation pawl 3, thereby separating the recording sheets one by one was explained, two separation pawls may be provided for regulating both front corners of the recording sheet or separation pad or pads may be provided for separating the recording sheet one by one. Further, in the aforementioned embodiments, while an example that the ink jet recording head is used as the recording head was explained, a recording head wherein ink is discharged from discharge opening by growth and contraction of a bubble created in the ink due to the film boiling caused by thermal energy generated in an electrothermal conversion element energized in response to a record signal may be used.

Preferably, the typical construction and principle thereof can be realized by using the fundamental principles, for example, disclosed in U.S. Pat. Nos. 4,723,129 and 5,740,796. Although this system can be applied to both a so-called "on-demand type" and "continuous type", it is more effective when the present invention is particularly applied to the on-demand type, because, by applying at least one drive signal corresponding to the record information and capable of providing the abrupt temperature increase exceeding the nucleate boiling to the electrothermal conversion elements arranged in correspondence to the paper or liquid passages including the liquid (ink) therein, it is possible to form a bubble in the liquid in corresponding to the drive signal by generating the film boiling on the heat acting surface of the recording head due to the generation of the thermal energy in the electrothermal conversion elements. Due to the growth and contraction of the bubble, the liquid is discharged from the discharge opening to form at least one ink droplet. When the drive signal has a pulse shape, since the growth and contraction of the bubble can be quickly effected, more excellent ink discharge is achieved.

Such pulse-shaped drive signal may be ones disclosed in U.S. Pat. Nos. 4,463,359 and 4,345,262. Incidentally, by adopting the condition disclosed in U.S. Pat. No. 4,313,124 providing the invention regarding the temperature increasing rate on the heat acting surface, a further excellent recording can be performed.

As the construction of the recording head, the present invention includes the construction wherein the heat acting portion is disposed in an arcuate area as disclosed in U.S. Pat. Nos. 4,558,333 and 4,459,600, as well as the constructions wherein the discharge openings, liquid paths and electrothermal conversion elements are combined (straight liquid paths or orthogonal liquid paths).

In addition, the present invention can applicable to the construction wherein each discharge opening is constituted by a slit with which a plurality of electrothermal conversion elements associated in common as disclosed in the Japanese Patent Laid-Open Application No. 59-123670 and the construction wherein openings for absorbing the pressure wave of the thermal energy are arranged in correspondence to the discharge openings as disclosed in the Japanese Patent Laid-Open Application No. 59-138461, because the recording can be correctly and effectively performed regardless of the configuration of the recording head.

Further, the present invention can be applied to a recording head of full-line type having a length corresponding to a maximum width of a recording medium to be recorded, as such recording head, the construction wherein such length is attained by combining a plurality of recording heads or a single recording head integrally formed may be adopted. In addition, among the above-mentioned serial types, the present invention is effectively applicable to a removable recording head of chip type wherein, when mounted on the recording system, electrical connection between it and the recording system and the supply of ink from the recording system can be permitted, or to a recording head of cartridge type wherein a cartridge is integrally formed with the head.

Further, it is preferable that a head recovering means and an auxiliary aiding means are added to the recording head according to the present invention, since the effect of the present invention is further improved. More concretely, these means include a capping means for capping the recording head, cleaning means, pressurizing or suction means, and an auxiliary heating means comprising electrothermal converters or other heating elements or the combination thereof. Further, it is effective for the stable recording to perform an auxiliary discharge mode wherein the ink discharge regardless of the recording ink discharge is effected.

Further, as to the kind and number of the recording head to be mounted, each recording head may correspond to each different color ink, or a plurality of recording heads can be used for a plurality of ink having different colors and/or different density. That is to say, for example, the present invention can effectively be applied not only to a recording mode with a single main color such as black, but also to a system providing a plurality of different colors and/or a full-color by mixing colors by using an integrated recording head or the combination of plural recording heads.

Further, in the illustrated embodiments, while the ink was liquid, the ink may be solid in a room temperature or less, or may be softened at a room temperature. In the above-mentioned ink jet recording system, since the temperature control is generally effected in a temperature range from 30° C. to 70° C. so that the viscosity of the ink is maintained within a stable discharging range, the ink may be liquidized when the record signal is emitted. In addition, ink having a feature that is firstly liquidized by the thermal energy, such as solid ink which serves to prevent the increase in temperature by absorbing energy in changing the ink from the solid state to the liquid state or which is in the solid state in the preserved condition to prevent the vaporization of ink and which is liquidized into ink liquid to be discharged in response to the record signal comprising the thermal energy, or ink which has already been solidified upon reaching the recording medium, can also be applied to the present invention.

In such a case, the ink can be held in the liquid state or solid state in recesses or holes in porous sheet as disclosed in the Japanese Patent Laid-Open Application Nos. 54-56847 and 60-71260, in confronting relation to the electrothermal converters. Incidentally, in the present invention the above-mentioned film boiling principle is most effective for each ink. Further, the aforementioned ink jet recording apparatus may be used as image output terminals of information processing systems such as computers or may be used with a copying machine incorporating a reader therein or a facsimile system having transmission/receiver function.

Further, in the aforementioned embodiment, while an example that the ink jet recording head is used as the recording means was explained, the present invention is not limited to the ink jet recording head, but, a heat-transfer recording method, a heat sensitive recording method or other recording methods other than an impact recording method such as a dot wire recording method can be applied to the present invention. In addition, the present invention is not limited to the serial recording method, but may be applied to a so-called line recording method.

What is claimed is:

1. An recording apparatus comprising:

a sheet supporting means for supporting sheets;

rotatable sheet supply means for feeding out the sheets supply means having a high friction portion which can be abutted against the sheet to feed out the sheets;

guide means extended in a sheet feeding direction for guiding a side edge of the sheet when the sheet is fed out by said sheet supply means;

a separation pawl arranged at the same side as said guide means in the sheet feeding direction for separating sheets fed out by said sheet supply means one by one;

spacing means arranged at said rotatable sheet supply means for spacing said high friction portion from the sheet while said sheet is being fed; and recording means for recording an image on the sheet the skew-feed of which was corrected;

wherein said spacing means acts on the sheet to rotate it in a plane thereof, and one side edge of the sheet is abutted against said guide means by rotating said sheet, thereby correcting a skew-feed of the sheet.

2. A sheet feeding apparatus comprising:

a sheet supporting means for supporting sheets;

rotatable sheet supply means for feeding out the sheets supported by said supporting means, said rotatable sheet supply means having a high friction portion which can be abutted agains the sheets to feed out the sheets;

guide means extended in a sheet feeding direction for guiding a side edge of a sheet when the sheet is fed out by said sheet supply means;

a separation pawl arranged at the same side as said guide means in a sheet widthwise direction for separating sheets fed out by said sheet supply means one by one; and spacing means arranged at said rotatable sheet supply means for spacing said high friction portion from the sheet while said sheet is being fed;

wherein said spacing means acts on the sheet to rotate it in a plane thereof, and one side edge of the sheet is abutted against said guide means by rotating said sheet, thereby correcting a skew-feed of the sheet.

3. A sheet feeding apparatus comprising:

a sheet supporting means for supporting a sheet;

a rotatable sheet supply means for feeding out the sheet supported by said sheet supporting means, said rotatable sheet supply means having a high friction portion which can be abutted against the sheet to feed out said sheet; and a plurality of spacing means arranged along a widthwise direction of the sheet supported by said sheet supporting means to space said high friction portion from the sheet while said sheet is being fed;

wherein said plurality of spacing means act on the sheet at different timings to rotate said sheet in a plane including a surface of said sheet, thereby correcting a skew-feed of said sheet.

4. A sheet feeding apparatus according to claim 3, wherein said spacing means comprise projections protruded from said rotatable sheet supply means in a radial direction, and said timings are differentiated from each other by differentiating circumferential lengths of said projections from each other.

5. A sheet feeding apparatus according to claim 3, wherein said spacing means comprise projections protruded from said rotatable sheet supply means in a radial direction, and said timings are differentiated from each other by differentiating radial heights of said projections from each other.

6. A sheet feeding apparatus according to one of claims 3 to 5, further comprising a guide means arranged at a reference position when the sheet is supplied, and wherein the skew-feed of the sheet is corrected by abutting one side edge of the sheet against said guide means by rotating said sheet by said spacing means.

7. A sheet feeding apparatus according to one of claims 3 to 5, wherein said rotatable sheet supply means comprises a plurality of sheet supply rollers arranged along a widthwise direction of the sheet supported by said sheet supporting means, and said spacing means are provided on both of said sheet supply rollers.

8. A sheet feeding apparatus according to any one of claims 3 to 5, wherein said rotatable sheet supply means comprises a single sheet supply roller extending along a widthwise direction of the sheet supported by said sheet supporting means, and said spacing means are provided on both ends of said sheet supply roller.

9. A sheet feeding apparatus according to claim 6, further comprising a separation means for separating the sheets fed out by said rotatable sheet supply means one by one, and wherein the spacing operations of said spacing means are started after the sheet is separated by said separation means.

10. A sheet feeding apparatus according to claim 9, wherein said separation means is a separation pawl arranged on said guide means, and said spacing means acts on the sheet after the sheet is separated by said separation pawl.

11. A sheet feeding apparatus according to claim 4 or 5, wherein said projections are made of low friction material so that the sheet is not fed out when said projections are abutted against said sheet.

12. A sheet feeding apparatus according to claim 3, wherein said rotatable sheet supply means has a sheet supply roller having a cut-out at its periphery, and a roller arranged in coaxial with said sheet supply roller, and said sheet supporting means has a rockable plate for supporting the sheet, and a biasing means for biasing said plate toward said sheet supply roller.

13. A sheet feeding apparatus according to claim 6, wherein a spacing operation by said spacing means near to said guide means starts later than said spacing means remote therefrom, and said spacing means near to said guide means releases the spacing operation earlier than said spacing means remote therefrom.

14. A sheet feeding apparatus according to claim 6, wherein both of said spacing means near to and remote from said guide start a spacing operation simultaneously, and said spacing means near to said guide means releases the spacing operation earlier than said spacing means remote therefrom.

15. A sheet feeding apparatus according to claim 6, wherein said spacing means near to said guide means starts a spacing operation later than said spacing means remote therefrom, and both of said near to and remote from said guide means release the spacing operation simultaneously.

16. A sheet feeding apparatus according to claim 6, wherein said spacing means to said guide means effects a spacing operation earlier than said spacing means remote therefrom to rotate the sheet in a direction so that the side edge thereof is spaced from said guide means, and then, said spacing means near to said guide means releases the spacing operation earlier than said spacing means remote therefrom to thereby rotate the sheet in an opposite direction.

17. A recording apparatus comprising:

sheet supporting means for supporting a sheet;

a rotatable sheet supply means for feeding out the sheet supported by said sheet supporting means, said rotatable sheet supply means having a high friction portion which can be abutted against the sheet to feed out said sheet;

a plurality of spacing means arranged along a widthwise direction of the sheet supported by said sheet supporting means to space said high friction portion from the sheet while said sheet is being fed, said plurality of spacing means acting on the sheet at different timings to rotate said sheet in a plane including a surface of said sheet, thereby correcting a skew-feed of said sheet; and a recording means for recording an image on the sheet the skew-feed of which was corrected.

18. A recording apparatus according to claim 17, wherein said recording means is of ink jet recording type in which ink is discharged from a discharge opening by utilizing film boiling of the ink caused by thermal energy applied from an electrothermal converter.

19. A sheet feeding apparatus comprising:

a sheet supporting means for supporting sheets;

a plurality of rotatable sheet supply means arranged along a widthwise direction of the sheets supported by said sheet supporting means for feeding out a sheet;

guide means disposed upstream of said plurality of rotatable sheet supply means in a sheet feeding direction, said guide means extended in a sheet feeding direction for guiding a side edge of the sheet when the sheet is fed out by said sheet supply means; and a separation pawl arranged at the same side as said guide means in a sheet widthwise direction for separating sheets fed out by said sheet supply means one by one;

wherein a sheet feeding amount of said sheet supply means situated near to said guide means is set larger than that of said sheet supply means remote from said guide means, so that the sheet supplied by said plurality of sheet supply means is rotated in a plane thereof, to be abutted onto said guide means at the side edge thereof for correcting a skew-feed of said sheet.

20. A sheet feeding apparatus according to claim 19, wherein said rotatable sheet supply means is a plurality of sheet supply rollers each having, at its outer periphery, a high friction portion for feeding out the sheet by contacting with said sheet and arranged along a widthwise direction of the sheet supported by said sheet supporting means, so that the sheet is rotated by differentiating radii of said high friction portions from each other, thereby correcting the skew-feed of said sheet.

21. A sheet feeding apparatus according to claim 19, further comprising a convey means arranged at a downstream side, and wherein the rotation of the sheet effected by said rotatable sheet supply means is completed before a tip end of said sheet reaches said convey means.

22. A recording apparatus comprising:

a sheet supporting means for supporting sheets;

a plurality of rotatable sheet supply means arranged along a widthwise direction of the sheets supported by said sheet supporting means for feeding out a sheet;

guide means disposed upstream of said plurality of rotatable sheet supply means in a sheet feeding direction, said guide means extended in a sheet feeding direction for guiding a side edge of the sheet when the sheet is fed out by said sheet supply means;

a separation pawl arranged at the same side as said guide means in a sheet widthwise direction for separating sheets fed out by said sheet supply means one by one;

a recording means for recording an image on a sheet a skew-feed of which was corrected;

a recording means for recording an image on the sheet the skew-feed of which was corrected, wherein a sheet feeding amount of said sheet supply means situated near to said guide means is set larger than that of said sheet supply means remote from said guide means, so that the sheet supplied by said plurality of sheet supply means is rotated in a plane thereof, to be abutted onto said guide means at the side edge thereof for correcting a skew-feed of the sheet.

23. A recording apparatus according to claim 22, wherein said recording means is of ink jet recording type in which ink is discharged from a discharge opening by utilizing film boiling of the ink caused by thermal energy applied from an electro-thermal converter.

* * * * *

UNITED STATES PATENT AND TRADEMARK OFFICE

CERTIFICATE OF CORRECTION

PATENT NO. : 5,725,319
DATED : March 10, 1998
INVENTOR(S) : Hiroyuki SAITO, et al.

It is certified that error appears in the above-identified patent and that said Letters Patent is hereby corrected as shown below:

Figures 9A and 9B, delete "CIRCUMFERENCIAL", both occurrences, and insert therefor --CIRCUMFERENTIAL--.

Column 1, line 14, delete "a".

Column 4, line 48, delete "by heating the liquid".

Column 6, line 49, after "arranged", insert --on--.

Column 8, line 13, delete "with" and insert therefor --without--.

Column 9, line after "anti-clockwise", insert --direction--;
Line 59, delete "porgram" and insert therefor --program--;
Line 65, delete "positons" and insert therefor --positions--.

Column 11, line 37, delete "predriving for" and insert therefor --preventing the--.

Column 12, line 51, delete "are" and insert therefor --is--.

Column 17, line 45, delete "An" and insert therefor --A--;
Line 48, after "sheets", insert --, said--.

Column 18, line 4, delete "agains" and insert therefor --against--.

UNITED STATES PATENT AND TRADEMARK OFFICE

CERTIFICATE OF CORRECTION

PATENT NO. : 5,725,319
DATED : March 10, 1998
INVENTOR(S) : Hiroyuki SAITO, et al.

It is certified that error appears in the above-identified patent and that said Letters Patent is hereby corrected as shown below:

Column 19, line 32, after "said", first occurrence, insert --spacing means--;
Line 35, after "means", first occurrence, insert --near--.

Signed and Sealed this

Twenty-fifth Day of August, 1998

Bruce Lehman

*Attest:*

BRUCE LEHMAN

*Attesting Officer*

*Commissioner of Patents and Trademarks*